US009761185B2

(12) United States Patent
Takanashi et al.

(10) Patent No.: US 9,761,185 B2
(45) Date of Patent: Sep. 12, 2017

(54) IMAGE DISPLAY APPARATUS AND CONTROL METHOD THEREFOR

(71) Applicant: CANON KABUSHIKI KAISHA, Tokyo (JP)

(72) Inventors: Ikuo Takanashi, Fujisawa-shi (JP); Yoshiyuki Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 14/678,224

(22) Filed: Apr. 3, 2015

(65) Prior Publication Data

US 2015/0287370 A1 Oct. 8, 2015

(30) Foreign Application Priority Data

Apr. 7, 2014 (JP) ..... 2014-078645

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 3/3611* (2013.01); *G09G 2320/029* (2013.01); *G09G 2320/0606* (2013.01); *G09G 2320/0646* (2013.01); *G09G 2320/0666* (2013.01); *G09G 2320/0693* (2013.01); *G09G 2360/145* (2013.01)

(58) Field of Classification Search
CPC ..... G09G 2320/029; G09G 2320/0693; G09G 3/3607
See application file for complete search history.

(56) References Cited

U.S. PATENT DOCUMENTS

2010/0002026 A1* 1/2010 Seetzen ..... G09G 3/3426 345/690
2010/0013750 A1 1/2010 Kerofsky et al.
2011/0175874 A1* 7/2011 Wakimoto ..... G09G 3/3406 345/207

FOREIGN PATENT DOCUMENTS

CN 101540157 A 9/2009
CN 101587698 A 11/2009
(Continued)

OTHER PUBLICATIONS

The above foreign patent documents were cited in the Dec. 5, 2016 Chinese Office Action, a copy of which is Enclosed with an English Translation, that issued in Chinese Patent Application No. 201510160874.8.

*Primary Examiner* — Michael Faragalla
*Assistant Examiner* — Chayce Bibbee
(74) *Attorney, Agent, or Firm* — Cowan, Liebowitz & Latman, P.C.

(57) ABSTRACT

An image display apparatus includes a light-emitting unit, a display unit configured to modulate light from the light-emitting unit, a light-emission control unit configured to control light emission of the light-emitting unit, a display control unit configured to execute display processing for displaying images for calibration in order, an acquiring unit configured to acquire a measurement value of light emitted from a region, of a screen, where the image for calibration is displayed, and a calibrating unit configured to execute a calibration on the basis of measurement values of the images, wherein when a light emission state of the light-emitting unit changes during the execution of the display processing, the display control unit executes the display processing again.

15 Claims, 14 Drawing Sheets

(56) References Cited

FOREIGN PATENT DOCUMENTS

| | | | |
|---|---|---|---|
| CN | 101632113 | A | 1/2010 |
| CN | 102713735 | A | 10/2012 |
| JP | 2008-090076 | A | 4/2008 |
| JP | 2009-237366 | A | 10/2009 |
| JP | 2013-068810 | A | 4/2013 |

* cited by examiner

FIG. 4

IMAGE GROUP FOR MEASUREMENT A

| NUMBER | PIXEL VALUE | | |
|---|---|---|---|
| | R VALUE | G VALUE | B VALUE |
| 1 | 255 | 0 | 0 |
| 2 | 0 | 255 | 0 |
| 3 | 0 | 0 | 255 |

FIG. 5

IMAGE GROUP FOR MEASUREMENT A

| NUMBER | PIXEL VALUE | | | MEASUREMENT VALUE | | |
|---|---|---|---|---|---|---|
| | R VALUE | G VALUE | B VALUE | X VALUE | Y VALUE | Z VALUE |
| 1 | 255 | 0 | 0 | XR | YR | ZR |
| 2 | 0 | 255 | 0 | XG | YG | ZG |
| 3 | 0 | 0 | 255 | XB | YB | ZB |

FIG. 8

IMAGE GROUP FOR MEASUREMENT B

| NUMBER | PIXEL VALUE | | |
|---|---|---|---|
| | R VALUE | G VALUE | B VALUE |
| 1 | 0 | 0 | 0 |
| 2 | 64 | 64 | 64 |
| 3 | 128 | 128 | 128 |
| 4 | 192 | 192 | 192 |
| 5 | 255 | 255 | 255 |

FIG. 9

IMAGE GROUP FOR MEASUREMENT B

| NUMBER | PIXEL VALUE | | | MEASUREMENT VALUE | | |
|---|---|---|---|---|---|---|
| | R VALUE | G VALUE | B VALUE | X VALUE | Y VALUE | Z VALUE |
| 1 | 0 | 0 | 0 | X1 | Y1 | Z1 |
| 2 | 64 | 64 | 64 | X2 | Y2 | Z2 |
| 3 | 128 | 128 | 128 | X3 | Y3 | Z3 |
| 4 | 192 | 192 | 192 | X4 | Y4 | Z4 |
| 5 | 255 | 255 | 255 | X5 | Y5 | Z5 |

FIG. 14

IMAGE GROUP FOR MEASUREMENT A
(FOR COLOR ADJUSTMENT)

| NUMBER | PIXEL VALUE | | |
|---|---|---|---|
| | R VALUE | G VALUE | B VALUE |
| 1 | 255 | 0 | 0 |
| 2 | 0 | 255 | 0 |
| 3 | 0 | 0 | 255 |

IMAGE GROUP FOR MEASUREMENT B
(FOR GRADATION ADJUSTMENT)

| NUMBER | PIXEL VALUE | | |
|---|---|---|---|
| | R VALUE | G VALUE | B VALUE |
| 1 | 0 | 0 | 0 |
| 2 | 64 | 64 | 64 |
| 3 | 128 | 128 | 128 |
| 4 | 192 | 192 | 192 |
| 5 | 255 | 255 | 255 |

IMAGE GROUP FOR MEASUREMENT C
(FOR CONTRAST ADJUSTMENT)

| NUMBER | PIXEL VALUE | | |
|---|---|---|---|
| | R VALUE | G VALUE | B VALUE |
| 1 | 0 | 0 | 0 |
| 2 | 255 | 255 | 255 |

IMAGE DISPLAY APPARATUS AND CONTROL METHOD THEREFOR

BACKGROUND OF THE INVENTION

Field of the Invention

The present invention relates to an image display apparatus and a control method therefor.

Description of the Related Art

Conventionally, as a technique concerning a liquid-crystal display apparatus, a technique for using a backlight including a plurality of light sources to control light emission brightness (light emission amounts) of the light sources according to a statistic of input image data has been proposed (Japanese Patent Application Laid-open No. 2008-090076). By performing such control, it is possible to improve contrast of a displayed image (an image displayed on a screen). Such control (control for partially changing the light emission brightness of the backlight) is called "local dimming control".

In an image display apparatus, a technique for calibrating, using an optical sensor that measures light (a displayed image) from a screen, display brightness and a display color (brightness and a color of the screen or brightness or a color of the displayed image) has been proposed (Japanese Patent Application Laid-open No. 2013-068810).

In the calibration of the image display apparatus, usually, a measurement value of each of a plurality of images for calibration displayed on the screen in order (a measurement value of the optical sensor) is used. Therefore, when the calibration is performed while the local dimming control is performed, during the execution of the calibration, in some case, light emission brightness of light sources changes and the measurement value of the optical sensor changes. As a result, the calibration sometimes cannot be highly accurately executed.

Japanese Patent Application Laid-open No. 2013-068810 discloses a technique for highly accurately performing calibration while performing the local dimming control. Specifically, in the technique disclosed in Japanese Patent Application Laid-open No. 2013-068810, when the calibration is performed, a change in light emission brightness due to the local dimming control is suppressed in light sources provided around a measurement position of an optical sensor. Consequently, it is possible to suppress the light emission brightness of the light sources provided around the measurement position of the optical sensor from changing during the execution of the calibration. It is possible to suppress a measurement value of the optical sensor from changing during the execution of the calibration.

However, in the technique disclosed in Japanese Patent Application Laid-open No. 2013-068810, if a region where a change in the light emission brightness due to the local dimming control is suppressed is large, an effect of improvement of contrast by the local dimming control decreases and the quality of a displayed image is deteriorated.

Since lights from the light sources disuse, in the technique disclosed in Japanese Patent Application Laid-open No. 2013-068810, if a region where a change in the light emission brightness due to the local dimming control is suppressed is small, the measurement value of the optical sensor sometimes greatly changes because of a change in the light emission brightness of the light sources in other regions. As a result, the calibration sometimes cannot be highly accurately executed.

Note that, not only when the local dimming control is performed but also when light emission of a backlight is controlled on the basis of input image data, the problems explained above (the deterioration in the quality of the displayed image, the deterioration in the accuracy of the calibration, etc.) occur.

SUMMARY OF THE INVENTION

The present invention provides a technique that can highly accurately execute calibration of an image display apparatus while suppressing deterioration in the quality of a displayed image.

The present invention in its first aspect provides an image display apparatus capable of executing calibration of at least one of brightness and a color of a screen, the image display apparatus comprising:

a light-emitting unit;

a display unit configured to display an image on the screen by modulating light from the light-emitting unit;

a light-emission control unit configured to control light emission of the light-emitting unit on the basis of input image data;

a display control unit configured to execute display processing for displaying a plurality of images for calibration on the screen in order;

an acquiring unit configured to execute, for each of the plurality of images for calibration, processing for acquiring a measurement value of light emitted from a region, of the screen, where the image for calibration is displayed; and a calibrating unit configured to execute the calibration on the basis of the measurement values of the plurality of images for calibration, wherein when a light emission state of the light-emitting unit changes during the execution of the display processing from a light emission state of the light-emitting unit before the execution of the display processing, the display control unit executes at least a part of the display processing again.

The present invention in its second aspect provides a control method for an image display apparatus capable of executing calibration of at least one of brightness and a color of a screen, the image display apparatus including:

a light-emitting unit;

a display unit configured to display an image on the screen by modulating light from the light-emitting unit; and a light-emission control unit configured to control light emission of the light-emitting unit on the basis of input image data, the control method comprising:

executing display processing for displaying a plurality of images for calibration on the screen in order;

executing, for each of the plurality of images for calibration, processing for acquiring a measurement value of light emitted from a region, of the screen, where the image for calibration is displayed; and executing the calibration on the basis of the measurement values of the plurality of images for calibration, wherein in executing the display processing, when a light emission state of the light-emitting unit changes during the execution of the display processing from a light emission state of the light-emitting unit before the execution of the display processing, at least a part of the display processing is executed again.

The present invention in its third aspect provides a non-transitory computer readable medium that stores a program, wherein the program causes a computer to execute the method.

According to the present invention it is possible to highly accurately execute calibration of an image display apparatus while suppressing deterioration in the quality of a displayed image.

Further features of the present invention will become apparent from the following description of exemplary embodiments with reference to the attached drawings.

BRIEF DESCRIPTION OF THE DRAWINGS

FIG. 4 is a diagram showing an example of an image group for measurement according to the first embodiment;

FIG. 5 is a diagram showing an example of measurement values of the image group for measurement according to the first embodiment;

FIG. 8 is a diagram showing an image group for measurement according to the second embodiment;

FIG. 9 is a diagram showing an example of measurement values of the image group for measurement according to the second embodiment;

FIG. 14 is a diagram showing an example of a plurality of image groups for measurement according to the first embodiment.

DESCRIPTION OF THE EMBODIMENTS

First Embodiment

An image display apparatus and a control method therefor according to a first embodiment of the present invention are explained below with reference to the drawings. The image display apparatus according to this embodiment is an image display apparatus capable of executing calibration of at least one of brightness and a color of a screen.

Note that, in this embodiment, an example is explained in which the image display apparatus is a transmission-type liquid-crystal display apparatus. However, the image display apparatus is not limited to the transmission-type liquid-crystal display apparatus. The image display apparatus only has to be an image display apparatus including an independent light source. For example, the image display apparatus may be a reflection-type liquid-crystal display apparatus. The image display apparatus may be an MEMS shutter-type display including a micro electro mechanical system (MEMS) shutter instead of a liquid crystal element.

Configuration of the Image Display Apparatus

Figure 1:
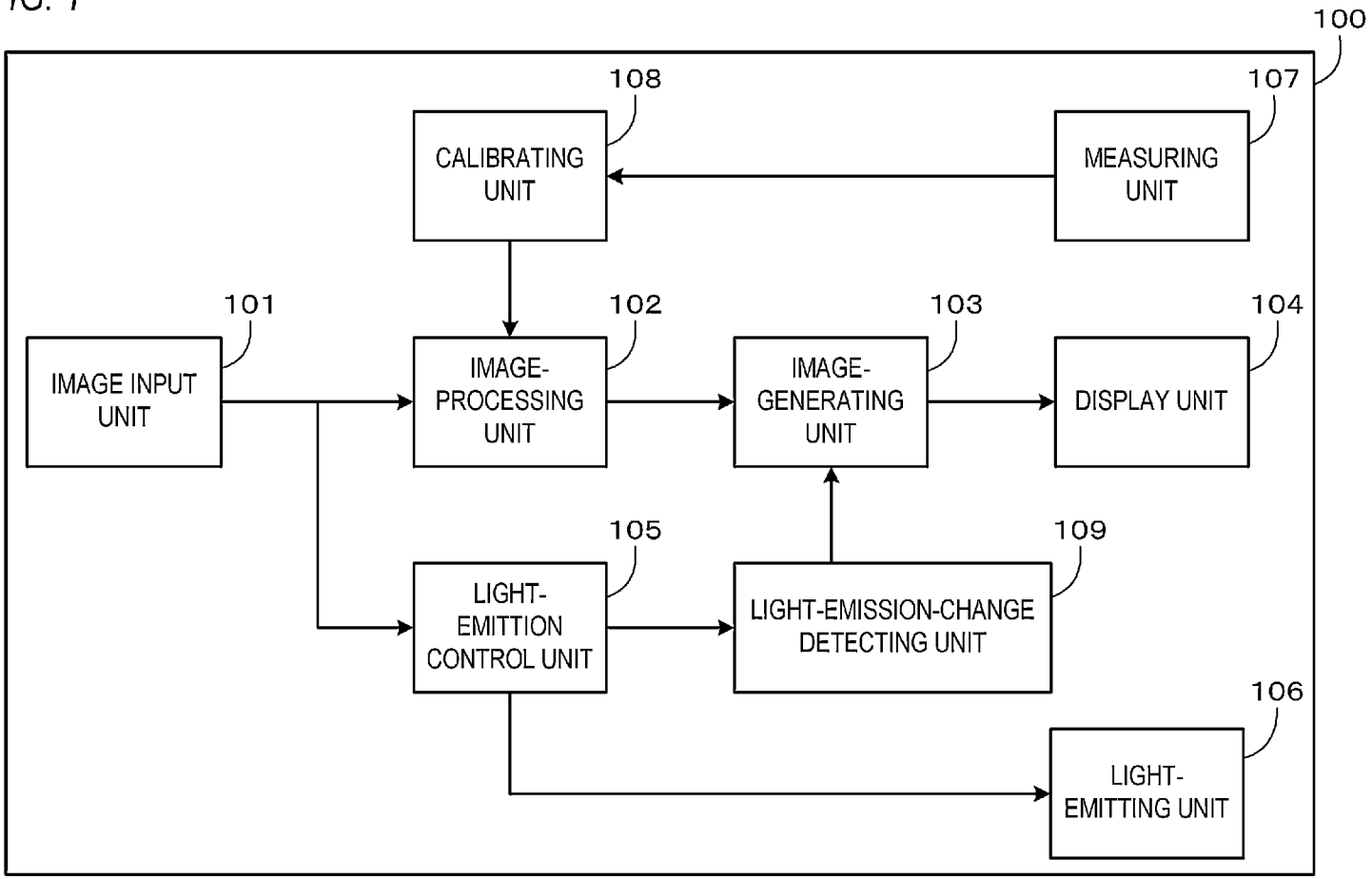
FIG. 1 is a block diagram showing an example of a functional configuration of an image display apparatus according to a first embodiment.

FIG. 1 is a block diagram showing an example of a functional configuration of an image display apparatus 100 according to this embodiment. As shown in FIG. 1, the image display apparatus 100 includes an image input unit 101, an image-processing unit 102, an image-generating unit 103, a display unit 104, a light-emission control unit 105, a light-emitting unit 106, a measuring unit 107, a calibrating unit 108, and a light-emission-change detecting unit 109.

The image input unit 101 is, for example, an input terminal for image data. As the image input unit 101, input terminals adapted to standards such as high-definition multimedia interface (HDMI), digital visual interface (DVI), and DisplayPort can be used. The image input unit 101 is connected to an image output apparatus such as a personal computer or a video player. The image input unit 101 acquires (receives) image data output from the image output apparatus and outputs the acquired image data (input image data) to the image-processing unit 102 and the light-emission control unit 105.

The image-processing unit 102 generates processed image data by applying image processing to the input image data output from the image input unit 101. The image-processing unit 102 outputs the generated processed image data to the image-generating unit 103.

The image processing executed by the image-processing unit 102 includes, for example, brightness correction processing and color correction processing. According to the image processing applied to the input image data, brightness and a color of a screen are changed (corrected) when an image based on the input image data is displayed on a screen. The image-processing unit 102 applies the image processing to the input image data using image processing parameters determined by the calibrating unit 108. The image processing parameters includes, for example, an R gain value, a G gain value, a B gain value, and a pixel-value conversion look up table (LUT). The R gain value is a gain value to be multiplied with an R value (a red component value) of image data. The G gain value is a gain value to be multiplied with a G value (a green component value) of the image data. The B gain value is a gain value to be multiplied with a B value (a blue component value) of the image data. The pixel-value conversion LUT is a data table representing a correspondence relation between pixel values before conversion of image data and pixel values after the conversion. For example, the pixel-value conversion LUT is a table data representing pixel values after the conversion for each of pixel values before conversion. The image-processing unit 102 multiplies an R value of the input image data with the R gain value, multiplies a G value of the input image data with the G gain value, and multiplies a B value of the input image data with the B gain value to thereby correct brightness and a color of the input image data. The image-processing unit 102 converts pixel values of the image data after the multiplication of the gain values using the pixel-value conversion LUT to thereby correct levels of the pixel values. Consequently, processed image data is generated.

Note that, in this embodiment, an example is explained in which the pixel values of the input image data are RGB values. However, the pixel values of the input image data are not limited to the RGB values. For example, the pixel values may be YCbCr values.

Note that the image processing parameters are not limited to the R gain value, the G gain value, the B gain value, and the pixel-value conversion LUT. The image processing is not limited to the processing explained above. For example, the image processing parameters do not have to include the pixel-value conversion LUT. The processed image data may be generated by multiplying the input image data with a gain value. The image processing parameters do not have to include the gain values. The processed image data may be generated by converting pixel values of the input image data using the pixel-value conversion LUT. A pixel value conversion function representing a correspondence relation between pixel values before conversion and pixel values after conversion may be used instead of the pixel-value conversion LUT. The image processing parameters may include addition values to be added to pixel values. The processed image data may be generated by adding the addition values to the pixel values of the input image data.

When calibration is executed, the image-generating unit 103 executes display processing for displaying a plurality of images for calibration (images for measurement) on a screen in order (display control).

Specifically, when the calibration is executed, the image-generating unit 103 combines image data for measurement with the processed image data output from the image-processing unit 102. Consequently, image data for display representing an image obtained by superimposing an image (an image for measurement) represented by the image data for measurement on an image (a processed image) represented by the processed image data is generated. The image-generating unit 103 outputs the image data for display to the display unit 104. In this embodiment, an image group for measurement including a plurality of images for measurement is determined in advance. The image-generating unit 103 performs the processing for generating and outputting the image data for display for each of the images for measurement included in the image group for measurement.

Note that, in this embodiment, when the calibration is performed, light emitted from a predetermined region of the screen is measured. The image-generating unit 103 generates the image data for display such that the image for measurement is displayed in the predetermined region. Therefore, in this embodiment, in the display processing, the plurality of images for measurement are displayed in the same region of the screen.

In a period in which the calibration is not executed, the image-generating unit 103 outputs the processed image data output from the image-processing unit 102 to the display unit 104 as the image data for display.

As explained in detail below, in this embodiment, the light-emission-change detecting unit 109 detects a change in a light emission state of the light-emitting unit 106. During the execution of the display processing for displaying the plurality of images for measurement on the screen in order, if the light emission state of the light-emitting unit 106 changes from the light emission state of the light-emitting unit 106 before the execution of the display processing, the image-generating unit 103 executes the display processing again. Specifically, when the light-emission-change detecting unit 109 detects a change in the light emission state of the light-emitting unit 106, the light-emission-change detecting unit 109 outputs change information. If the image-generating unit 103 receives the change information during the execution of the display processing, the image-generating unit 103 executes the display processing again.

The display unit 104 modulates the light from the light-emitting unit 106 to display an image on the screen. In this embodiment, the display unit 104 is a liquid crystal panel including a plurality of liquid crystal elements. The transmittance of the liquid crystal elements is controlled according to the image data for display output from the image-generating unit 103. The light from the light-emitting unit 106 is transmitted through the liquid crystal elements at the transmittance corresponding to the image data for display, whereby an image is displayed on the screen.

The light-emission control unit 105 controls light emission (light emission brightness, a light emission color, etc.) of the light-emitting unit 106 on the basis of the image data for input output from the image input unit 101. Specifically, the light-emission control unit 105 determines a light emission control value on the basis of the input image data. The light-emission control unit 105 sets (outputs) the determined light emission control value in (to) the light-emitting unit 106. That is, in this embodiment, the light emission control value set in the light-emitting unit 106 is controlled on the basis of the input image data. The light emission control value is a target value of the light emission brightness, the light emission color, or the like of the light-emitting unit 106. The light emission control value is, for example, pulse width or pulse amplitude of a pulse signal, which is a driving signal applied to the light-emitting unit 106. If the light emission brightness (a light emission amount) of the light-emitting unit 106 is pulse width modulation (PWM)-controlled, the pulse width of the driving signal only has to be determined as the light emission control value. If the light emission brightness of the light-emitting unit 106 is pulse amplitude modulation (PAM)-controlled, the pulse amplitude of the driving signal only has to be determined as the light emission control value. If the light emission brightness of the light-emitting unit 106 is pulse harmonic modulation (PHM)-controlled, both of the pulse width and the pulse amplitude of the driving signal only have to be determined as the light emission control value.

In this embodiment, the light-emitting unit 106 includes a plurality of light sources (light emitting blocks), the light emission of which can be individually controlled. The light-emission control unit 105 controls the light emission of the light sources (local dimming control) on the basis of image data (a part or all of the input image data) that is to be displayed in regions of the screen respectively corresponding to the plurality of light sources. Specifically, the light source is provided in each of a plurality of divided regions configuring the region of the screen. The light-emission control unit 105 acquires, for each of the divided regions, a feature value of the input image data in the divided region. The light-emission control unit 105 determines, on the basis of the feature value acquired for the divided region, a light emission control value of the light source provided in the divided region. The feature value is, for example, a histogram or a representative value of pixel values, a histogram or a representative value of brightness values, a histogram or a representative value of chromaticity, or the like. The representative value is, for example, a maximum, a minimum, an average, a mode, or a median. The light-emission control unit 105 outputs a determined light emission control value to the light-emitting unit 106.

The light emission brightness is increased in the light source in a bright region of the input image data and is reduced in a dark region of the input image data, whereby it is possible to increase contrast of a displayed image (an image displayed on the screen). For example, if the light emission control value is determined such that the light emission brightness is higher as brightness represented by the feature value is higher, it is possible to increase the contrast of the displayed image.

If the light emission color of the light source is controlled to match a color of the input image data, it is possible to expand a color gamut of the displayed image and increase chroma of the displayed image.

Note that the region corresponding to the light source is not limited to the divided region. As the region corresponding to the light source, a region overlapping the region corresponding to another light source may be set or a region not in contact with a region corresponding to another light source may be set. For example, the region corresponding to the light source may be a region larger than the divided region or may be a region smaller than the divided region.

In this embodiment, it is assumed that, as a plurality of regions corresponding to the plurality of light sources, a plurality of regions different from one another are set. However, the region corresponding to the light source is not limited to this. For example, as the region corresponding to the light source, a region same as a region corresponding to another light source may be set.

The light-emitting unit 106 functions as a planar light emitting body and irradiates light (e.g., white light) on the back of the display unit 104. The light-emitting unit 106 emits light corresponding to the set light emission control value.

As explained above, the light-emitting unit 106 includes a plurality of light sources, the light emission of which can be individually controlled. The light source includes one or more light emitting elements. As the light emitting element, for example, a light emitting diode (LED), an organic electro-luminescence (EL) element, or a cold-cathode tube element can be used. The light source emits light according to a light emission control value determined for the light source. Light emission brightness of the light source increases according to an increase in pulse width or pulse amplitude of a driving signal. In other words, the light emission brightness of the light source decreases according to a decrease in the pulse width or the pulse amplitude of the driving signal. If the light source includes a plurality of light emitting elements having light emission colors different from one another, not only the light emission brightness of the light source but also a light emission color of the light source can be controlled. Specifically, by changing a ratio of light emission brightness among the plurality of light emitting elements of the light source, it is possible to change the light emission color of the light source.

Figure 2:
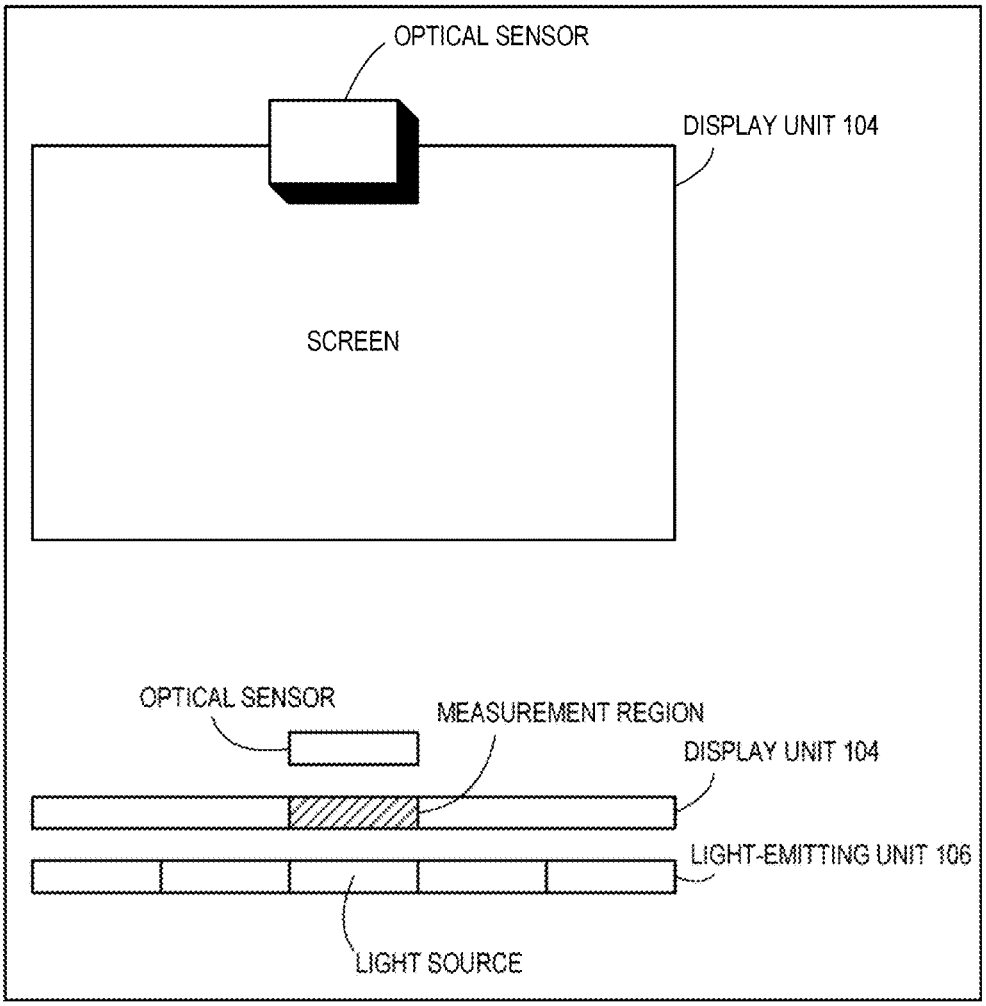
FIG. 2 is a diagram showing an example of a positional relation between an optical sensor and a display section according to the first embodiment.

The measuring unit 107 executes, for each of the plurality of images for measurement, processing for acquiring a measurement value of light (screen light) emitted from a region where the image for measurement is displayed in the region of the screen. For example, the measuring unit 107 includes an optical sensor that measures the screen light and acquires a measurement value of the screen light from the optical sensor. An example of a positional relation between the optical sensor and the display unit 104 (the screen) is shown in FIG. 2. The upper side of FIG. 2 is a front view (a view from the screen side) and the lower side of FIG. 2 is a side view. In the side view, besides the optical sensor and the display unit 104, a predetermined measurement region and the light-emitting unit 106 are also shown. In FIG. 2, the optical sensor is provided at the upper end of the screen. The optical sensor is disposed with a detection surface (a measurement surface) of the optical sensor directed in the direction of the screen such that light from a part of the region of the screen (a predetermined measurement region) is measured. In the example shown in FIG. 2, the optical sensor is provided such that the measurement surface is opposed to the measurement region. The image for measurement is displayed in the measurement region. The optical sensor measures a display color and display brightness of the image for measurement. The measuring unit 107 outputs a measurement value acquired from the optical sensor to the calibrating unit 108. The measurement value is, for example, tristimulus values XYZ.

Note that the measurement value of the screen light may be any value. For example, the measurement value may be an instantaneous value of the screen light, may be a time average of the screen light, or may be a time integration value of the screen light. The measuring unit 107 may acquire the instantaneous value of the screen light from the optical sensor and calculate, as the measurement value, the time average or the time integration value of the screen light from the instantaneous value of the screen light. If the instantaneous value of the screen light is easily affected by noise, for example, if the screen light is dark, it is preferable to extend a measurement time of the screen light and acquire the time average or the time integration value of the screen light as the measurement value. Consequently, it is possible to obtain the measurement value less easily affected by noise.

Note that the optical sensor may be an apparatus separate from the image display apparatus 100.

Note that the measurement region of the screen light does not have to be the predetermined region. For example, the measurement region may be a region changeable by a user.

The calibrating unit 108 acquires (receives) the measurement value output from the measuring unit 107. The calibrating unit 108 executes calibration of the image display apparatus 100 on the basis of the measurement values of the plurality of images for measurement. Specifically, the calibrating unit 108 determines, on the basis of the measurement values of the plurality of images for measurement, image processing parameters used in the image processing executed by the image-processing unit 102. Details of a determination method for the image processing parameters are explained below.

The light-emission-change detecting unit 109 acquires the light emission control value output from the light-emission control unit 105 (the light emission control value set in the light-emitting unit 106) and determines a light emission state of the light-emitting unit 106 on the basis of the light emission control value set in the light-emitting unit 106 (state determination processing).

In this embodiment, the light-emission-change detecting unit 109 determines the light emission state of the light-emitting unit 106 in the region where the image for measurement is displayed (the predetermined measurement region).

Specifically, the light-emission-change detecting unit 109 acquires, on the basis of light emission control values of the light sources, brightness of the light irradiated on the measurement region by the light-emitting unit 106.

Note that, as the light emission state, a light emission color of the light-emitting unit 106 may be determined rather than the light emission brightness of the light-emitting unit 106. As the light emission state, both of the light emission brightness and the light emission color of the light-emitting unit 106 may be determined.

Since the light from the light source diffuses, not only the light from the light source located in the measurement region but also light from the light source located outside the measurement region (diffused light; leak light) is irradiated on the measurement region. That is, the brightness of the light irradiated on the measurement region by the light-emitting unit 106 is brightness of combined light of lights from the plurality of light sources.

The light-emission-change detecting unit 109 acquires, as the brightness of the light emitted from the light source in the measurement region and irradiated on the measurement region, light emission brightness corresponding to the light emission control value of the light source. The light emission brightness corresponding to the light emission control value can be determined using a function or a table representing a correspondence relation between the light emission control value and the light emission brightness. If the light emission brightness corresponding to the light emission control value is proportional to the light emission control value, the light emission control value may be used as the light emission brightness corresponding to the light emission control value.

The light-emission-change detecting unit 109 acquires, as the brightness of the light emitted from the light source outside the measurement region and irradiated on the measurement region, a value obtained by multiplying light emission brightness corresponding to a light emission brightness value of the light source with a coefficient.

The light-emission-change detecting unit 109 acquires, as the brightness of the light irradiated on the measurement region by the light-emitting unit 106, a sum of the acquired brightness of the light sources.

In this embodiment, a diffusion profile representing the coefficient multiplied with the light emission brightness for each of the light sources is prepared in advance. The light-emission-change detecting unit 109 reads out the coefficient from the diffusion profile and multiplies the light emission brightness corresponding to the light emission brightness value with the read-out coefficient to thereby calculate the brightness of the light emitted from the light source and irradiated on the measurement region. The coefficient is an arrival rate of the light emitted from the light source and reaching the measurement region. Specifically, the coefficient is a brightness ratio of light emitted from the light source and is a ratio of brightness in the position of the measurement region to brightness in the position of the light source. A decrease in the brightness of the light emitted from the light source and reaching the measurement region is smaller as the distance between the light source and the measurement region is shorter. Therefore, in the diffusion profile, a larger coefficient is set as the distance between the light source and the measurement region is shorter. In other words, the decrease in the brightness of the light emitted from the light source and reaching the measurement region is larger as the distance between the light source and the measurement region is longer. Therefore, in the diffusion profile, a smaller coefficient is set as the distance between the light source and the measurement region is longer. In this embodiment, 1 is set as a coefficient corresponding to the light source in the measurement region. A value smaller than 1 is set as a coefficient corresponding to the light source outside the measurement region.

Note that the light emission state of the light-emitting unit 106 in the measurement region may be acquired using light emission control values of all the light sources or may be acquired using light emission control values of a part of the light sources. For example, the light emission state may be acquired using a light emission control value of the light source in the measurement region and a light emission control value of the light source, a distance to which from the measurement region is equal to or smaller than a threshold. The threshold may be a fixed value determined in advance by a manufacturer or may be a value changeable by the user. Light emission brightness corresponding to a light emission control value of the light source located right under the measurement region (e.g., the light source closest to the center of the measurement region) may be acquired as the light emission state. In particular, if diffusion of the light from the light source is little, it is preferable to acquire, as the light emission state, light emission brightness corresponding to the light emission control value of the light source located right under the measurement region. If the diffusion of the light from the light source is little, even if the light emission brightness corresponding to the light emission control value of the light source located right under the measurement region is acquired as the light emission state, it is possible to obtain a light emission state with a small error. It is possible to reduce a processing load by not taking into account the light sources other than the light source located right under the measurement region.

The light-emission-change detecting unit 109 detects a change in the light emission state of the light-emitting unit 106 on the basis of a result of the state determination processing (change determination processing).

Specifically, every time the image for measurement is displayed, the light-emission-change detecting unit 109 compares the present light emission state of the light-emitting unit 106 and a light emission state of the light-emitting unit 106 before the execution of the display processing for displaying the plurality of images for measurement on the screen in order. Every time the image for measurement is displayed, the light-emission-change detecting unit 109 determines, according to a result of the comparison of the light emission states, whether the light emission state of the light-emitting unit 106 changes from the light emission state of the light-emitting unit 106 before the execution of the display processing. If the light-emission-change detecting unit 109 determines that the light emission state of the light-emitting unit 106 changes from the light emission state of the light-emitting unit 106 before the execution of the display processing, the light-emission-change detecting unit 109 outputs change information to the image-generating unit 103.

In this embodiment, the light-emission-change detecting unit 109 detects a change in a light emission state in the predetermined measurement region.

Note that the state determination processing and the change determination processing may be executed by functional units different from each other. For example, the image display apparatus 100 may include a state-determining unit that executes the state determination processing and a change-determining unit that executes the change determination processing.

Operation of the Image Display Apparatus

Figure 3:
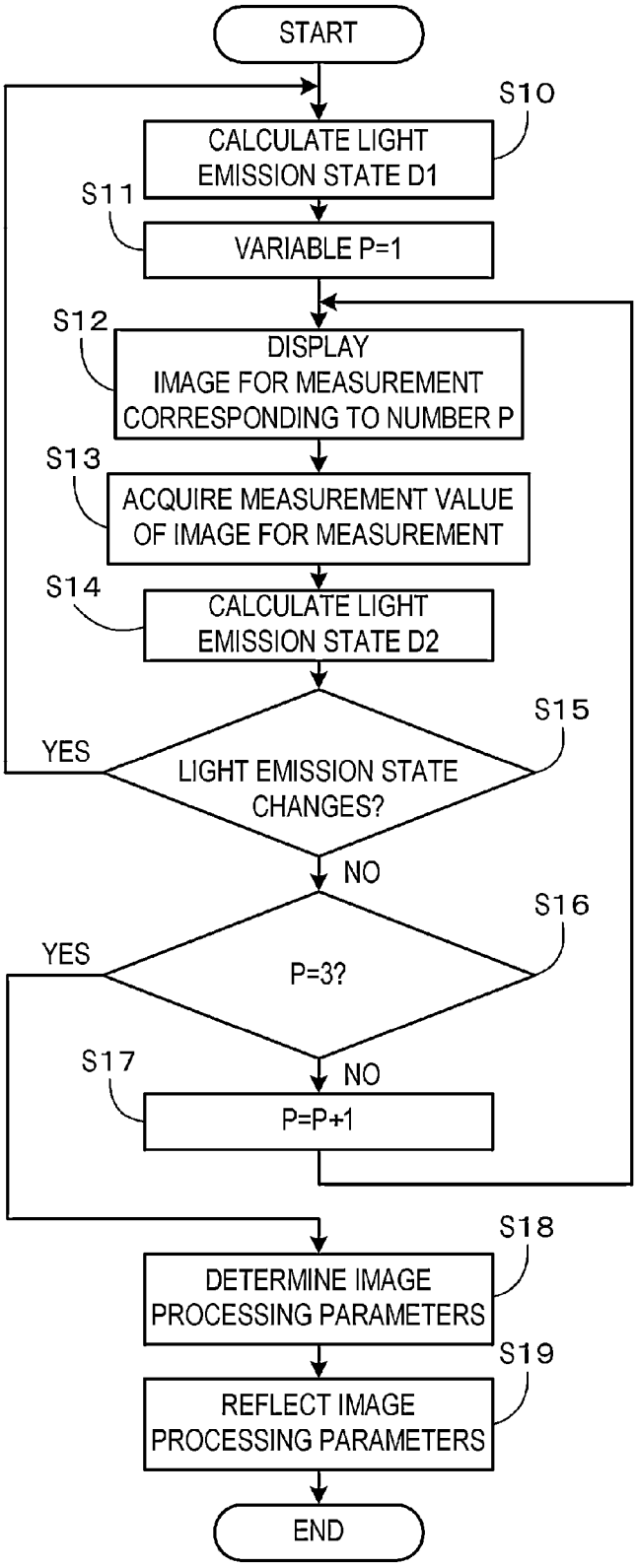
FIG. 3 is a flowchart for explaining an example of the operation of the image display apparatus according to the first embodiment.

FIG. 3 is a flowchart for explaining an example of the operation of the image display apparatus 100. FIG. 3 shows an example of an operation in executing calibration of at least one of the brightness and the color of the screen. In the following explanation, an example is explained in which the image processing parameters of the image-processing unit 102 are adjusted using measurement values of N (N is an integer equal to or larger than 2) images for measurement belonging to image group for measurement A such that tristimulus values, which are measurement values of screen light obtained when a white image is displayed, are (XW, YW, ZW).

Note that a method of the calibration is not limited to this method. For example, the image processing parameters may be adjusted such that a measurement value of screen light obtained when a red image is displayed, a measurement value of screen light obtained when a green image is displayed, and a measurement value of screen light obtained when a blue image is displayed respectively coincide with target values.

Note that one image group for measurement may be prepared or a plurality of image groups for measurement may be prepared. One of the plurality of image groups for measurement may be selected and the image processing parameters may be adjusted on the basis of the measurement values of a plurality of images for measurement belonging to the selected image group for measurement. The plurality of image groups for measurement may be selected in order and, for each of the image groups for measurement, processing for adjusting the image processing parameters on the basis of the measurement values of a plurality of images for measurement belonging to the image group for measurement may be performed. In that case, different image processing parameters may be adjusted among the image groups for measurement.

First, the light-emission-change detecting unit 109 receives a light emission control value output from the light-emission control unit 105 and calculates a light emission state D1 of the light-emitting unit 106 in the measurement region (S10). For example, brightness of light irradiated on the measurement region by the light-emitting unit 106 is calculated as the light emission state D1 using the light emission control value of the light source in the measurement region, the light emission control value of the light source around the measurement region, and the diffusion profile. Specifically, a sum of the light emission control value of the light source in the measurement region and a value obtained by multiplying the light emission control value of the light source around the measurement region with the coefficient (the coefficient represented by the diffusion profile) is calculated as the light emission state D1. The light emission state D1 is a light emission state of the light-emitting unit 106 before the execution of the display processing for displaying the plurality of images on the screen in order. In the example shown in FIG. 3, processing in S12 to S17 includes the display processing.

Subsequently, the image-generating unit 103 sets "1" in a variable P indicating a number of the image for measurement (S11). Numbers 1 to N are associated with the N images for measurement belonging to the image group for measurement A.

The image-generating unit 103 displays, on the screen, the image for measurement corresponding to the variable P (the number P) among the N images for measurement belonging to the image group for measurement A (S12). An example of the image group for measurement A is shown in FIG. 4. In the example shown in FIG. 4, three images for measurement belong to the image group for measurement A. Numbers 1 to 3 are associated with the three images for measurement. FIG. 4 shows an example in which gradation levels (an R value, a G value, and a B value) are 8-bit values. In the case of the variable P=1, an image for measurement with pixel values (an R value, a G value, and a B value)=(255, 0, 0) is displayed on the screen. In the case of the variable P=2, an image for measurement with pixel values (0, 255, 0) is displayed on the screen. In the case of the variable P=3, an image for measurement with pixel values (0, 0, 255) is displayed on the screen.

Subsequently, the measuring unit 107 acquires a measurement value of the image for measurement displayed in S12 (S13). Specifically, the optical sensor measures light from a region where the image for measurement is displayed in the region of the screen. The measuring unit 107 acquires the measurement value of the image for measurement from the optical sensor.

The light-emission-change detecting unit 109 receives the light emission control value output from the light-emission control unit 105 and calculates a light emission state D2 of the light-emitting unit 106 in the measurement region on the basis of the received light emission control value (S14). The light emission state D2 is calculated by a method same as the method of calculating the light emission state D1. The light emission state D2 is a light emission state of the light-emitting unit 106 during the execution of the display processing. Specifically, the light emission state D2 is a light emission state of the light-emitting unit 106 at the time when the image for measurement with the number P is displayed.

Subsequently, the light-emission-change detecting unit 109 determines whether a degree of change of the light emission state D2 with respect to the light emission state D1 is equal to or larger than a threshold (S15). If the degree of change is equal to or larger than the threshold, the light-emission-change detecting unit 109 determines that a change in the light emission state of the light-emitting unit 106 is detected and outputs change information to the image-generating unit 103. The processing is returned to S10. The processing for displaying the N images for measurement belonging to the image group for measurement A on the screen in order and measuring the images for measurement is executed again. If the degree of change is smaller than the threshold, the light-emission-change detecting unit 109 determines that a change in the light emission state of the light-emitting unit 106 is not detected. The processing is advanced to S16.

Specifically, the light-emission-change detecting unit 109 calculates, using the following Expression 1, a rate of change ΔE1 (=a rate of change ΔE) of the light emission state D2 (=a light emission state Db) with respect to the light emission state D1 (=a light emission state Da).

$$\Delta E1=|(D2-D1)/D1| \quad \text{(Expression 1)}$$

The light-emission-change detecting unit 109 compares the calculated rate of change ΔE1 with a threshold TH1. The threshold TH1 is a threshold for determining presence or absence of a change in a light emission state. The threshold TH1 can be determined according to an allowable error in adjusting a measurement value of screen light to a target value. For example, if a ratio (an error) of a difference between brightness of the screen light (brightness of a displayed image) and the target value to brightness of the target value is desired to be kept at 5% or less, a value equal to or smaller than 5% is set as the threshold TH1.

If the rate of change ΔE1 is equal to or larger than the threshold TH1, the light-emission-change detecting unit 109 determines that a change in the light emission state of the light-emitting unit 106 is detected and outputs change information to the image-generating unit 103. The processing is returned to S10. The processing for displaying the N images for measurement belonging to the image group for measurement A on the screen in order and measuring the images for measurement is executed again. If the rate of change ΔE1 is smaller than the threshold TH1, the light-emission-change detecting unit 109 determines that a change in the light emission state of the light-emitting unit 106 is not detected. The processing is advanced to S16.

Note that the threshold (e.g., the threshold TH1) compared with the degree of change may be a fixed value determined in advance by the manufacturer or may be a value changeable by the user.

Note that the degree of change is not limited to the rate of change ΔE1. For example, |D2−D1| may be calculated as the degree of change.

Note that, if the degree of change is equal to or larger than the threshold, after the degree of change decreases to be smaller than the threshold, the processing may be returned to S10. After a predetermined time from timing when it is determined that the degree of change is equal to or larger than the threshold, the processing may be returned to S10. If it is determined that the degree of change is equal to or larger than the threshold, after a predetermined time from timing when the degree of change or the light emission state D2 is acquired, the processing may be returned to S10.

In S16, the image-generating unit 103 determines whether the variable P is 3. If the variable P is smaller than 3, the processing is advanced to S17. If the variable P is 3, the processing is advanced to S18.

In S17, since the measurement concerning all the images for measurement belonging to the image group for measurement A is not completed, the image-generating unit 103 increases the variable P by 1. Thereafter, the processing is returned to S12. Display and measurement of the next image for measurement is performed.

In S18, since the measurement concerning all the images for measurement belonging to the image group for measurement A is completed, the calibrating unit 108 determines (adjusts) image processing parameters on the basis of the measurement values of the N images for measurement belonging to the image group for measurement A.

A specific example of the processing in S18 is explained in detail.

In the following explanation, an example is explained in which an R gain value, a G gain value, and a B gain value are determined on the basis of the measurement values of the images for measurement.

FIG. 5 shows an example of measurement values (tristimulus values) of the images for measurement of the image group for measurement A. In FIG. 5, measurement values (an X value, a Y value, a Z value) of a number 1 are (XR, YR, ZR), measurement values of a number 2 are (XG, YG, ZG), and measurement values of a number 3 are (XB, YB, ZB).

First, the calibrating unit 108 calculates, using the following Expression 2, from pixel values and measurement values (pixel values and measurement values shown in FIG. 5) of three images for measurement belonging to the image group for measurement A, a conversion matrix M for converting pixel values into tristimulus values. By multiplying pixel values with the conversion matrix M from the left, it is possible to convert the pixel values into the tristimulus values.

[Math. 1]

$$\begin{pmatrix} XR & XG & XB \\ YR & YG & YB \\ ZR & ZG & ZB \end{pmatrix} = M \begin{pmatrix} 255 & 0 & 0 \\ 0 & 255 & 0 \\ 0 & 0 & 255 \end{pmatrix} \quad \text{(Expression 2)}$$

Subsequently, the calibrating unit 108 calculates an inverse matrix INVM of the conversion matrix M. The inverse matrix INVM is a conversion matrix for converting tristimulus values into pixel values.

As indicated by the following Expression 3, the calibrating unit 108 multiplies target measurement values (XW, YW, ZW) with the inverse matrix INVM from the left to thereby calculate pixel values (RW, GW, BW). The target measurement values (XW, YW, ZW) are tristimulus values of screen light obtained when a white image (an image with pixel values (255, 255, 255)) is displayed. Therefore, if the image with the pixel values (RW, GW, BW) is displayed, the tristimulus values of the screen light coincide with the target measurement values (XW, YW, ZW). In other words, by controlling the transmittance of the display unit 104 to transmittance corresponding to the pixel values (RW, GW, BW), it is possible to obtain a displayed image in which tristimulus values of the screen light coincide with the target measurement values (XW, YW, ZW).

[Math. 2]

$$\begin{pmatrix} RW \\ GW \\ BW \end{pmatrix} = INVM \begin{pmatrix} XW \\ YW \\ ZW \end{pmatrix} \quad \text{(Expression 3)}$$

As indicated by Expressions 4-1 to 4-3, the calibrating unit 108 divides each of a gradation value RW, a gradation value GW, and a gradation value BW by 255 to thereby calculate an R gain value RG, a G gain value GG, and a B gain value BG, which are image processing parameters.

$$RG = R1/255 \quad \text{(Expression 4-1)}$$

$$GG = G1/255 \quad \text{(Expression 4-2)}$$

$$BG = B1/255 \quad \text{(Expression 4-3)}$$

Subsequently to S18, the calibrating unit 108 sets the image processing parameters determined in S18 in the image-processing unit 102 (S19; reflection of the image processing parameters). After the processing in S19, the image-processing unit 102 applies image processing to input image data using the image processing parameters set in S19.

For example, the calibrating unit 108 sets, in the image-processing unit 102, the R gain value RG, the G gain value GG, and the B gain value BG determined by the method explained above. As a result, the image-processing unit 102 multiplies an R value of the input image data with the R gain value GR, multiplies a G value of the input image data with the G gain value GG, and multiplies a B value of the input image data with the B gain value BG to thereby generate image data for display. If pixel values of the input image data are pixel values (255, 255, 255) of a white color, the pixel values are converted into pixel values (RW, GW, BW). The pixel values (RW, GW, BW) after the conversion are output to the display unit 104. As a result, the transmittance of the display unit 104 is controlled to transmittance corresponding to the pixel values (RW, GW, BW). It is possible to obtain a displayed image in which tristimulus value of the screen light coincide with the target measurement value (XW, YW, ZW).

As explained above, according to this embodiment, during the execution period of the calibration, an image based on the input image data is displayed by processing same as the processing in other periods. Specifically, in the execution period of the calibration, local dimming control same as the local dimming control in the other periods is performed. Consequently, it is possible to execute the calibration of the image display apparatus while suppressing deterioration in the quality of a displayed image (a decrease in contrast of the displayed image, etc.). According to this embodiment, during the execution of the display processing for displaying a plurality of images for calibration on the screen in order, if the light emission state of the light-emitting unit changes from the light emission state of the light-emitting unit before the execution of the display processing, the display processing is executed again. Consequently, as measurement values of the plurality of images for calibration, it is possible to obtain measurement values at the time when the light emission state of the light-emitting unit is stable. It is possible to highly accurately execute the calibration of the image display apparatus using the measurement values.

Note that, in this embodiment, the example is explained in which the light emission state of the light-emitting unit 106 is determined on the basis of the light emission control value. However, the determination of the light emission state of the light-emitting unit 106 is not limited to this. For example, since the light emission of the light-emitting unit 106 is controlled on the basis of the input image data, it is also possible to determine the light emission state of the light-emitting unit 106 on the basis of the input image data.

Note that, in this embodiment, the example is explained in which the local dimming control is performed. However, the control of the light emission of the light-emitting unit 106 is not limited to this. The light emission of the light-emitting unit 106 only has to be control led on the basis of the input image data. For example, the light-emitting unit 106 may include one light source corresponding to the entire region of the screen. Light emission of the one light source may be controlled on the basis of the input image data.

Note that, in this embodiment, the example is explained in which one image group for measurement A is prepared in advance. However, a plurality of image groups for measurement may be prepared in advance. An example of the plurality of image groups for measurement is shown in FIG. 14. In FIG. 14, image groups for measurement A to C are shown. In the example shown in FIG. 14, images for measurement are classified for each of purposes such as measurement and calibration. Specifically, in FIG. 14, the image group for measurement A is a group for color adjustment, the image group for measurement B is a group for gradation adjustment, and the image group for measurement C is a group for contrast adjustment.

If the plurality of image groups for measurement are prepared in advance, one of the plurality of image groups for measurement may be selected. Calibration may be executed using the selected image group for measurement. For each of the image groups for measurement, display processing for displaying a plurality of (two or more) images for calibration belonging to the image group for measurement on the screen in order may be executed. For each of the image groups for measurement, during the execution of the display processing for the image group for measurement, if the light emission state of the light-emitting unit 106 changes from the light emission state of the light-emitting unit 106 before the execution of the display processing, the display processing for the group may be executed again. Consequently, it is possible to reduce a processing time (e.g., a measurement time of the image for measurement). For example, if the light emission state changes in measurement for a second image group for measurement, re-measurement for a first image group for measurement is omitted. Only re-measurement for the second image group for measurement is executed. Subsequently, measurement for a third and subsequent image groups for measurement is executed. By omitting the re-measurement for the first image group for measurement, it is possible to reduce a processing time. Since the light emission state does not change during the measurement for the first image group for measurement, a highly accurate measurement result is obtained for the first image group for measurement. Therefore, even if the re-measurement for the first image group for measurement is omitted, the accuracy of the calibration is not deteriorated.

Second Embodiment

An image display apparatus and a control method therefor according to a second embodiment of the present invention are explained below with reference to the drawings. In this embodiment, an example is explained in which the image display apparatus includes a measuring unit (an optical sensor) that measures light emitted from a light-emitting unit.

Configuration of the Image Display Apparatus

Figure 6:
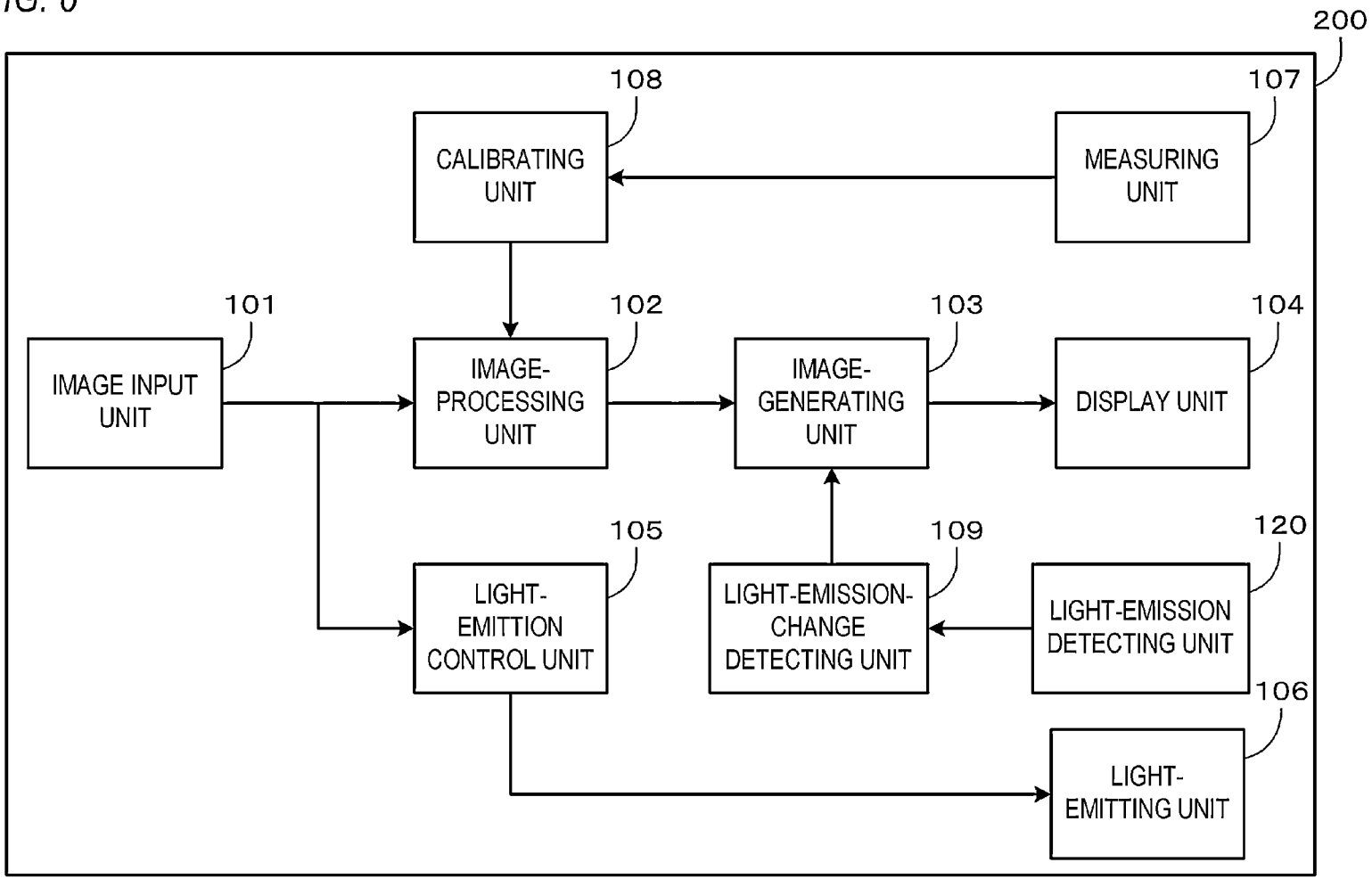
FIG. 6 is a block diagram showing an example of a functional configuration of an image display apparatus according to a second embodiment.

FIG. 6 is a block diagram showing an example of a functional configuration of an image display apparatus 200 according to this embodiment. As shown in FIG. 6, the image display apparatus 200 according to this embodiment includes a light-emission detecting unit 120 besides the functional units shown in FIG. 1.

Note that, in FIG. 6, functional units same as the functional units in the first embodiment (FIG. 1) are denoted by reference numerals same as the reference numerals in FIG. 1. Explanation of the functional units is omitted.

The light-emission detecting unit 120 is an optical sensor that measures light from the light-emitting unit 106. Specifically, the light-emission detecting unit 120 measures light from the light-emitting unit 106 in a light emission region. The light-emission detecting unit 120 measures, for example, at least one of brightness and a color of the light from the light-emitting unit 106. The light-emission detecting unit 120 is provided, for example, on a light emission surface (a surface that emits light) of the light-emitting unit 106. The light-emission detecting unit 120 outputs a measurement value of the light from the light-emitting unit 106 to the light-emission-change detecting unit 109.

The light-emission-change detecting unit 109 has a function same as the function of the light-emission-change detecting unit 109 in the first embodiment. However, in this embodiment, the light-emission-change detecting unit 109 uses, as the light emission state of the light-emitting unit 106, the measurement value output from the light-emission detecting unit 120. Therefore, in this embodiment, the state determination processing is not performed.

Operation of the Image Display Apparatus

Figure 7:
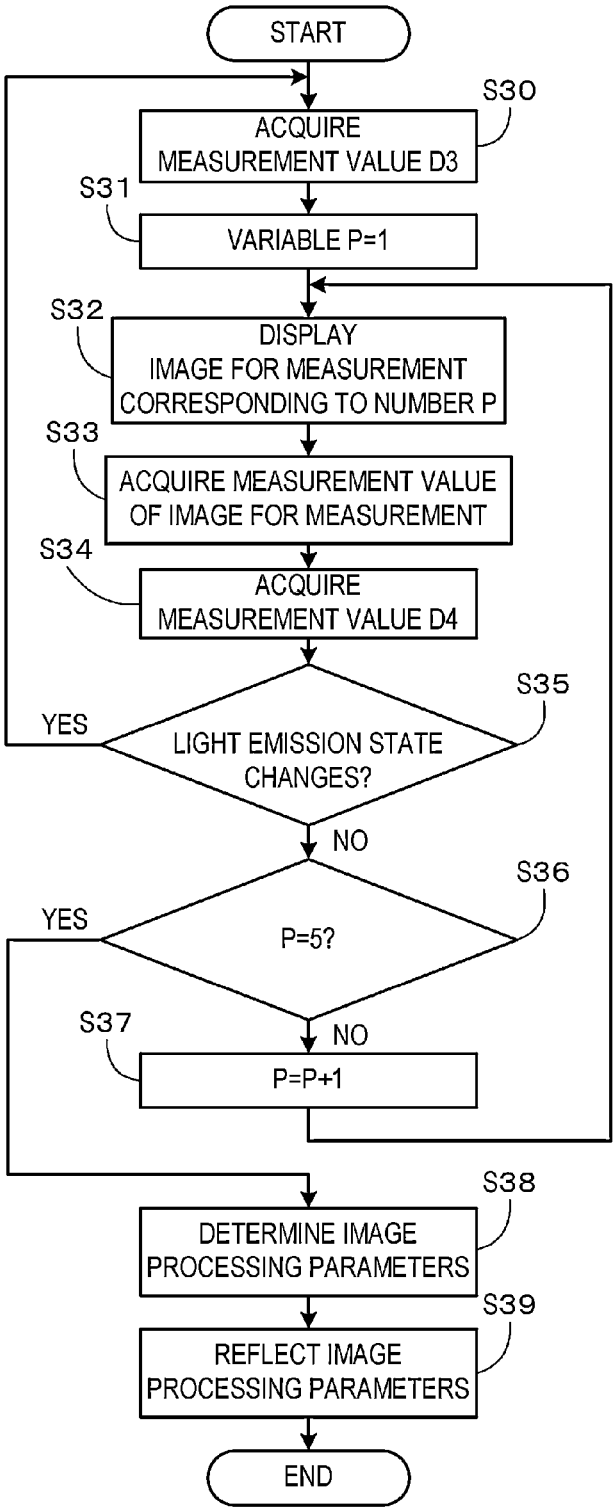
FIG. 7 is a flowchart for explaining an example of the operation of the image display apparatus according to the second embodiment.

FIG. 7 is a flowchart for explaining an example of the operation of the image display apparatus 200. FIG. 7 shows an example of an operation in executing calibration of the image display apparatus 200. In the following explanation, an example is explained in which image processing parameters of the image-processing unit 102 are adjusted using measurement values of N images for measurement belonging to an image group for measurement B. In the following explanation, an example is explained in which correction parameters of the image-processing unit 102 are adjusted such that a gradation characteristic, which is a change in a measurement value of a displayed image (screen light) with respect to a change in a gradation value of input image data, coincides with a gamma characteristic of a gamma value=2.2.

First, the light-emission detecting unit 120 measures light from the light-emitting unit 106 in the measurement region and outputs a measurement value D3 of the light (S30). The measurement value D3 is a measurement value be fore execution of display processing for displaying a plurality of images for measurement on the screen in order.

Subsequently, the image-generating unit 103 sets "1" in a variable P indicating a number of the image for measurement (S31).

The image-generating unit 103 displays, on the screen, the image for measurement corresponding to the variable P (the number P) among the N images for measurement belonging to the image group for measurement B (S32). An example of the image group for measurement B is shown in FIG. 8. In the example shown in FIG. 8, five images for measurement belong to the image group for measurement B. Numbers 1 to 5 are associated with the five images for measurement. FIG. 8 shows an example in which gradation levels (an R value, a G value, and a B value) are 8-bit values. In the case of the variable P=1, an image for measurement with pixel values (an R value, a G value, and a B value)=(0, 0, 0) is displayed on the screen. In the case of the variable P=2, an image for measurement with pixel values (64, 64, 64) is displayed on the screen. In the case of the variable P=3, an image for measurement with pixel values (128, 128, 128) is displayed on the screen. In the case of the variable P=4, an image for measurement with pixel values (192, 192, 192) is displayed on the screen. In the case of the variable P=5, an image for measurement with pixel values (255, 255, 255) is displayed on the screen.

Subsequently, the measuring unit 107 acquires a measurement value of the image for measurement displayed in S32 (S33).

The light-emission detecting unit 120 measures light from the light-emitting unit 106 in the measurement region and outputs a measurement value D4 of the light (S34). The measurement value D4 is a measurement value during the execution of the display processing. Specifically, the measurement value D4 is a measurement value obtained when the image for measurement of the number P is displayed.

Subsequently, the light-emission-change detecting unit 109 determines whether a degree of change of the light emission state of the light-emitting unit 106 during the execution of the display processing with respect to the light emission state of the light-emitting unit 106 before the execution of the display processing is equal to or larger than a threshold (S35). If the degree of change is equal to or larger than the threshold, the light-emission-change detecting unit 109 determines that a change in the light emission state of the light-emitting unit 106 is detected and outputs change information to the image-generating unit 103. The processing is returned to S30. The processing for displaying the N images for measurement belonging to the image group for measurement B on the screen in order and measuring the images for measurement is executed again. If the degree of change is smaller than the threshold, the light-emission-change detecting unit 109 determines that a change in the light emission state of the light-emitting unit 106 is not detected. The processing is advanced to S36. In S35, the measurement values D3 and D4 are used as the light emission state of the light-emitting unit 106.

Specifically, the light-emission-change detecting unit 109 calculates, using the following Expression 5, a rate of change ΔE2 (=a rate of change ΔE) of the light emission state D4 (=a light emission state Db) with respect to the light emission state D3 (=a light emission state Da).

$$\Delta E2=|(D4-D3)/D3| \quad \text{(Expression 5)}$$

The light-emission-change detecting unit 109 compares the calculated rate of change ΔE2 with a threshold TH2. The threshold TH2 is a threshold for determining presence or absence of a change in a light emission state. The threshold TH2 can be determined according to an allowable error in adjusting a gradation characteristic to a target characteristic (a gamma characteristic of a gamma value=2.2). For example, if a ratio (an error) of a difference between the gradation characteristic and the target characteristic to the target characteristic is desired to be kept at 5% or less, a value equal to or smaller than 5% is set as the threshold TH2.

If the rate of change ΔE2 is equal to or larger than the threshold TH2, the light-emission-change detecting unit 109 determines that a change in the light emission state of the light-emitting unit 106 is detected and outputs change information to the image-generating unit 103. The processing is returned to S30. The processing for displaying the N images for measurement belonging to the image group for measurement B on the screen in order and measuring the images for measurement is executed again. If the rate of change ΔE2 is smaller than the threshold TH2, the light-emission-change detecting unit 109 determines that a change in the light emission state of the light-emitting unit 106 is not detected. The processing is advanced to S36.

In S36, the image-generating unit 103 determines whether the variable P is 5. If the variable P is smaller than 5, the processing is advanced to S37. If the variable P is 5, the processing is advanced to S38.

In S37, since the measurement concerning all the images for measurement belonging to the image group for measurement B is not completed, the image-generating unit 103 increases the variable P by 1. Thereafter, the processing is returned to S32. Display and measurement of the next image for measurement is performed.

In S38, since the measurement concerning all the images for measurement belonging to the image group for measurement B is completed, the calibrating unit 108 determines (adjusts) image processing parameters on the basis of the measurement values of the N images for measurement belonging to the image group for measurement B.

A specific example of the processing in S38 is explained in detail.

In the following explanation, an example is explained in which a pixel-value conversion LUT for setting a gradation characteristic to a target characteristic is determined on the basis of the measurement values of the images for measurement.

FIG. 9 shows an example of measurement values (tristimulus values) of the images for measurement of the image group for measurement B. In FIG. 9, measurement values (an X value, a Y value, a Z value) of a number 1 are (X1, Y1, Z1), measurement values of a number 2 are (X2, Y2, Z2), and measurement values of a number 3 are (X3, Y3, Z3). Measurement values of a number 4 are (X4, Y4, Z4). Measurement values of a number 5 are (X5, Y5, Z5).

It is assumed that "Y3", which is a measurement value of the image for measurement of the number 3 (a measurement value of a brightness level), is a value lower by 5% than a brightness level of the target characteristic. In that case, since a gradation value of the image for measurement of the number 3 is 128, the calibrating unit 108 increases an output gradation value (an output value of the pixel-value conversion LUT) corresponding to an input gradation value (an input value of the pixel-value conversion LUT)=128 by 5%.

By performing the processing concerning all the images for measurement, the pixel-value conversion LUT after calibration is generated.

Note that, as the pixel-value conversion LUT, an LUT in which apart of gradation values, which the input image data could take, are set as input gradation values may be generated. An LUT in which all the gradation values, which the input image data could take, are set as the input gradation values may be generated. Measurement values corresponding to the input gradation values other than gradation values of the images for measurement can be estimated by performing interpolation processing or extrapolation processing using measurement values of the plurality of images for measurement.

Subsequently to S38, the calibrating unit 108 sets the image processing parameters determined in S38 in the image-processing unit 102 (S39). After the processing in S39, the image-processing unit 102 applies image processing to input image data using the image processing parameters set in S39.

For example, the calibrating unit 108 sets, in the image-processing unit 102, the pixel-value conversion LUT determined by the method explained above. As a result, the image-processing unit 102 converts pixel values of the input image data using the pixel-value conversion LUT to thereby generate image data for display. For example, gradation values (an R value, a G value, and a B value) of pixel values (128, 128, 128) of the input image data are converted into gradation values higher by 5% than an output gradation value corresponding to the input gradation value 128 in the pixel-value conversion LUT before the calibration. As a result, display conforming to a gamma characteristic of a gamma value=2.2 is performed.

Note that an output gradation value corresponding to a gradation value different from the input gradation value of the pixel-value conversion LUT can be determined by performing interpolation processing or extrapolation processing using the output gradation value of the pixel-value conversion LUT.

As explained above, according to this embodiment, as in the first embodiment, it is possible to highly accurately execute the calibration of the image display apparatus while suppressing deterioration in the quality of a displayed image.

Further, according to this embodiment, the measurement value of the light-emission detecting unit (the optical sensor) is used as the light emission state of the light-emitting unit. Since the measurement value of the light-emission detecting unit accurately represents the light emission state of the light-emitting unit, it is possible to more highly accurately detect a change in the light emission state of the light-emitting unit.

Third Embodiment

An image display apparatus and a control method therefor according to a third embodiment of the present invention are explained with reference to the drawings.

Configuration of the Image Display Apparatus

Figure 10:
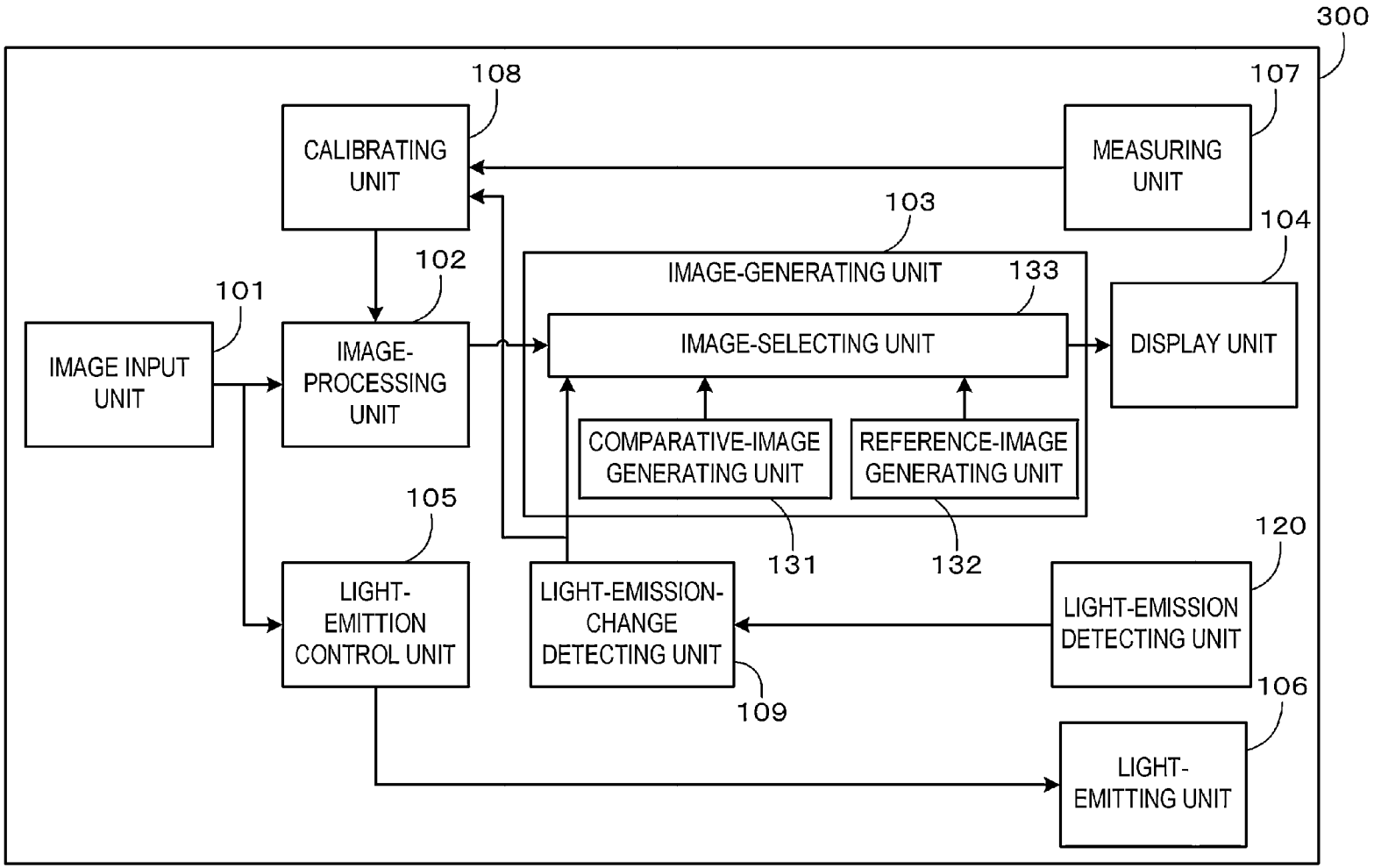
FIG. 10 is a block diagram showing an example of a functional configuration of an image display apparatus according to a third embodiment.

FIG. 10 is a block diagram showing an example of a functional configuration of an image display apparatus 300 according to this embodiment. The rough configuration of the image display apparatus 300 is the same as the configuration in the second embodiment (FIG. 6). However, in this embodiment, the image-generating unit 103 includes a comparative-image generating unit 131, a reference-image generating unit 132, and an image-selecting unit 133.

Note that, in FIG. 10, functional units same as the functional units shown in FIG. 6 are denoted by reference numerals same as the reference numerals in FIG. 6. Explanation of the functional units is omitted.

Note that the light-emission detecting unit 120 may not be used and the light-emission-change detecting unit 109 may perform the state determination processing explained in the first embodiment.

The comparative-image generating unit 131 generates a plurality of comparative image data respectively corresponding to N comparative images (second images) and outputs the generated comparative image data to the image-selecting unit 133. The comparative images are images for calibration (images for measurement). In this embodiment, when calibration is executed, measurement values of the comparative images are compared with a measurement value of a reference image explained below. In this embodiment, N pixel values are determined in advance as pixel values of the comparative images. The comparative-image generating unit 131 generates comparative image data according to the pixel values of the comparative images. Specifically, five gradation values of 0, 64, 128, 192, and 255 are determined in advance as gradation values of the comparative images. Five comparative image data corresponding to the five gradation values are generated.

Note that the gradation values of the comparative images are not limited to the values explained above. According to this embodiment, an example is explained in which comparative image data in which an R value, a G value, and a B value have pixel values equal to one another is generated. However, a gradation value of at least any one of the R value, the G value, and the B value of the comparative image data may be a value different from the other gradation values. For example, pixel values of the comparative image data may be (0, 64, 255).

The reference-image generating unit 132 generates reference image data representing a reference image (a first image) and outputs the generated reference image data to the image electing unit 133. The reference image is a reference image for calibration (a reference image for measurement). In this embodiment, pixel values of the reference image are determined in advance. The reference-image generating unit 132 generates reference image data according to the pixel values of the reference image. Specifically, 255 is determined in advance as a gradation value of the reference image. Reference image data in which pixel values are (255, 255, 255) is generated.

Note that the gradation value of the reference image may be lower than 255. If the number of bits of the gradation value is larger than 8 bits, the gradation value may be higher than 255. According to this embodiment, an example is explained in which reference image data in which an R value, a G value, and a B value have pixel values equal to one another is generated. However, a gradation value of at least any one of the R value, the G value, and the B value of the reference image data may be a value different from the other gradation values. For example, the pixel values of the reference image data may be (255, 0, 255).

When the calibration is executed, the image-selecting unit 133 selects one of N+1 image data for measurement including the reference image data and the N comparative image data. The image-selecting unit 133 generates image data for display from the selected image data for measurement and processed image data and outputs the generated image data for display to the display unit 104. When the calibration is executed, processing for selecting image data for measurement, generating image data for display using the selected image data for measurement, and outputting the generated image data for display is repeatedly performed. Consequently, N+1 images for measurement including the reference image and the N comparative images are displayed on the screen in order. In this embodiment, the image-selecting unit 133 performs display processing for displaying the N comparative images on the screen in order after displaying the reference image on the screen.

Note that the image-selecting unit 133 generates the image data for display such that the images for measurement are displayed in the measurement region.

In a period in which the calibration is not executed, the image-selecting unit 133 outputs the processed image data output from the image-processing unit 102 to the display unit 104 as the image data for display.

When an n-th (n is an integer equal to larger than 1 and equal to or smaller than N) comparative image is displayed, if the light emission state of the light-emitting unit 106 changes from the light emission state of the light-emitting unit 106 at the time when the reference image is displayed on the screen, the image-selecting unit 133 displays the reference image on the screen again. Thereafter, the image-selecting unit 133 executes display processing for displaying at least n-th and subsequent comparative images (N−n+1 comparative images) on the screen in order. Presence or absence of a change in the light emission state is determined according to change information as in the first and second embodiment.

Operation of the Image Display Apparatus

Figure 11:
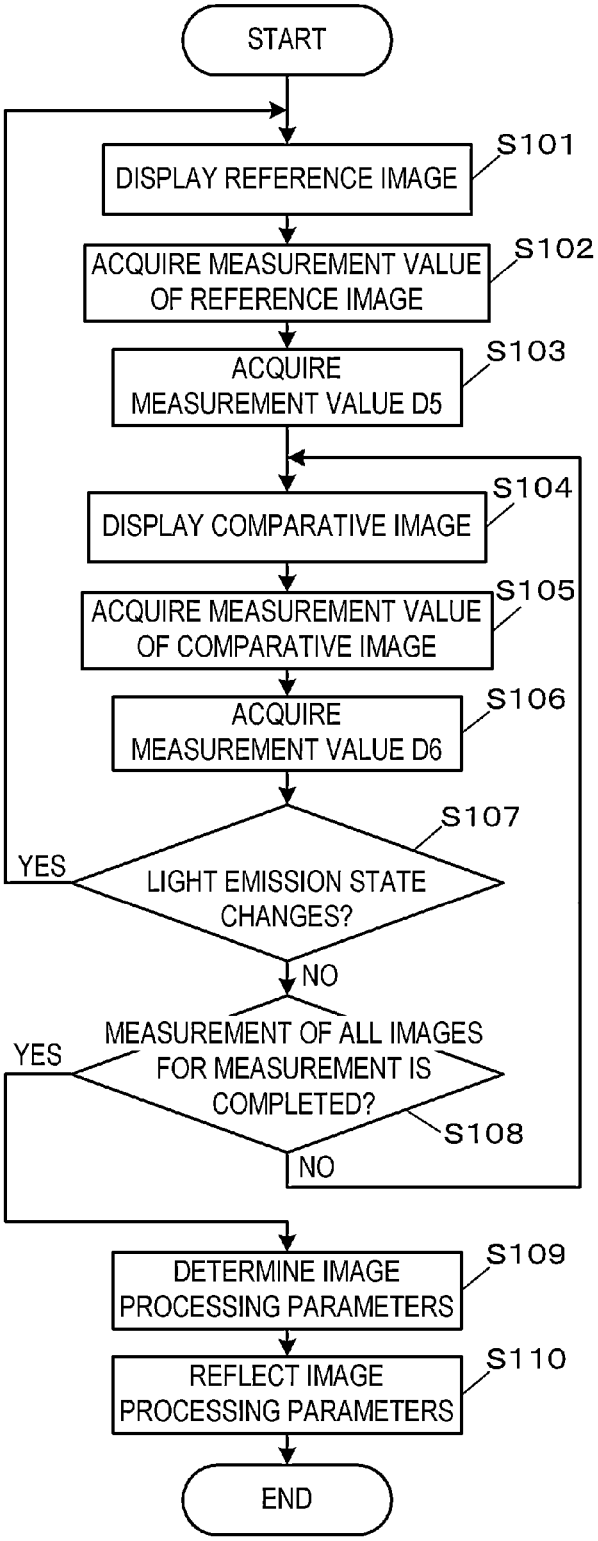
FIG. 11 is a flowchart for explaining an example of the operation of the image display apparatus according to the third embodiment.

FIG. 11 is a flowchart for explaining an example of the operation of the image display apparatus 300. FIG. 11 shows an example of an operation in executing calibration of the image display apparatus 300.

First, the image-selecting unit 133 displays the reference image generated by the reference-image generating unit 132 on the screen (S101). In this embodiment, a white image with a gradation value 255 is displayed as a reference image.

Subsequently, the measuring unit 107 acquires measurement values (tristimulus values) of the reference image (S102).

The light-emission detecting unit 120 measures light from the light-emitting unit 106 in the measurement region and outputs a measurement value D5 of the light to the light-emission-change detecting unit 109 (S103).

Subsequently, the image-selecting unit 133 displays the comparative image generated by the comparative-image generating unit 131 on the screen (S104). In S104, the image-selecting unit 133 selects one of the N comparative images and displays the selected comparative image on the screen. In this embodiment, as in the second embodiment, the five images for measurement (images for measurement of a gray color) shown in FIG. 8 are displayed as comparative images in order.

The measuring unit 107 acquires measurement values (tristimulus values) of the comparative image displayed in S104 (S105).

Subsequently, the light-emission detecting unit 120 measures light from the light-emitting unit 106 in the measurement region and outputs a measurement value D6 of the light to the light-emission-change detecting unit 109 (S106).

The light-emission-change detecting unit 109 determines whether a degree of change of the light emission state of the light-emitting unit 106 at the time when the comparative image is displayed in S104 with respect to the light emission state of the light-emitting unit 106 at the time when the reference image is displayed in S101 is equal to or larger than a threshold (S107). If the degree of change is equal to or larger than the threshold, the light-emission-change detecting unit 109 determines that a change in the light emission state of the light-emitting unit 106 is detected and outputs change information to the image-generating unit 103. The processing is returned to S101. However, in this embodiment, after the processing is returned to S101, display processing for displaying all the comparative images in order is not performed. After the processing is returned to S101, as the comparative image, the comparative image displayed last is displayed. If the comparative image, a measurement value of which is not acquired, is present, as the comparative image, the comparative image, a measurement value of which is not acquired, is displayed. If the degree of change is smaller than the threshold, the light-emission-change detecting unit 109 determines that a change in the light emission state of the light-emitting unit 106 is not detected. The processing is advanced to S108. In S107, the measurement values D5 and D6 are used as the light emission state of the light-emitting unit 106.

Specifically, the light-emission-change detecting unit 109 calculates, using the following Expression 6, a rate of change ΔE3 (=a rate of change ΔE) of the light emission state D6 (=a light emission state Db) with respect to the light emission state D5 (=a light emission state Da).

$$\Delta E3=|(D6-D5)/D5| \quad \text{(Expression 6)}$$

The light-emission-change detecting unit 109 compares the calculated rate of change ΔE3 with a threshold TH3. The threshold TH3 is a value determined by a method same as the method for determining the threshold TH2.

If the rate of change ΔE3 is equal to or larger than the threshold TH3, the light-emission-change detecting unit 109 determines that a change in the light emission state of the light-emitting unit 106 is detected and outputs change information to the image-generating unit 103. The processing is returned to S101. If the rate of change ΔE3 is smaller than the threshold TH3, the light-emission-change detecting unit 109 determines that a change in the light emission state of the light-emitting unit 106 is not detected. The processing is advanced to S108.

In S108, the image-selecting unit 133 determines whether measurement of all the images for measurement is completed. As in the first and second embodiments, it is determined using the variable P whether the measurement is completed. If the measurement is completed, the processing is advanced to S109. If the measurement is not completed, the processing is returned to S104. Measurement for the image for measurement not measured yet is performed.

Figure 12:
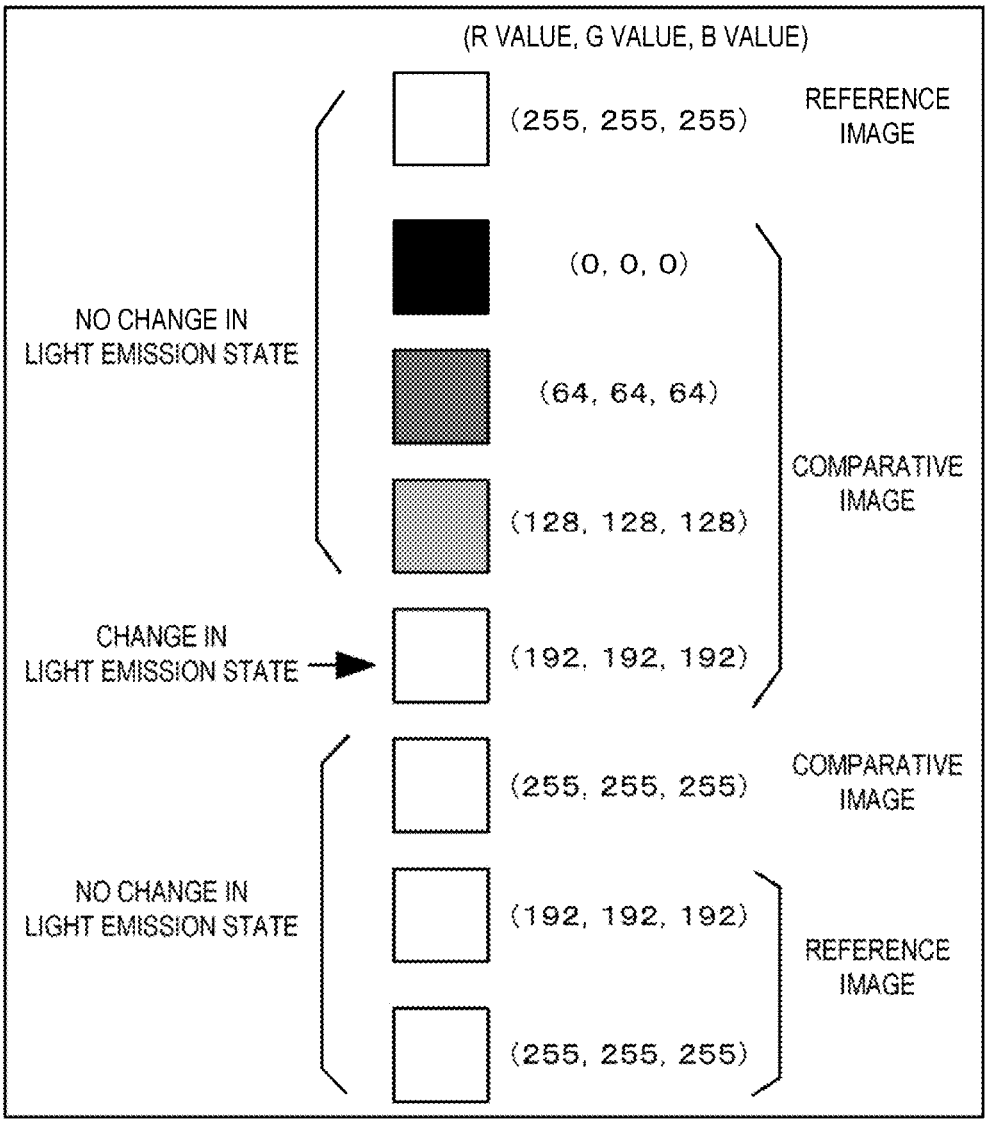
FIG. 12 is a diagram showing an example of measurement order of images for measurement according to the third embodiment.

In FIG. 12, an example of measurement order of the images for measurement by the processing in S101 to S108 is shown.

In this embodiment, measurement of five comparative images is performed in order after measurement of the reference image is performed. Specifically, a comparative image with a gradation value 0, a comparative image with a gradation value 64, a comparative image with a gradation value 128, a comparative image with a gradation value 192, and a comparative image with a gradation value 255 are measured in that order.

However, in this embodiment, if a change in the light emission state of the light-emitting unit is detected during the measurement of the comparative images, re-measurement of the comparative images is performed. Thereafter, re-measurement of the comparative images displayed when a change in the light emission state is detected is performed. If the comparative image not measured yet is present, measurement of the comparative image is also performed.

In the example shown in FIG. 12, a change in the light emission state of the light-emitting unit 106 is detected during measurement of the comparative image with the gradation value 192. As the comparative image not measured yet, the comparative image with the gradation value 255 is present. Therefore, after the measurement of the comparative image with the gradation value 192, re-measurement of the reference image, measurement of the comparative image with the gradation value 192, and measurement of the comparative image with the gradation value 255 are performed in that order.

In S109, the calibrating unit 108 determines image processing parameters.

In this embodiment, the calibrating unit 108 compares, for each of the comparative images, a measurement value of the comparative image and a measurement value of the reference image. The calibrating unit 108 determines the image processing parameters on the basis of a comparison result of the comparative images.

Specifically, the calibrating unit 108 calculates, using the following Expression 7, a ratio R_n of a measurement value (Y_n) of an n-th comparative image to a measurement value (Y_std) of the reference image.

$$R_n = Y_n / Y_std \quad \text{(Expression 7)}$$

The calibrating unit 108 calculates, from the calculated ratio R_n, a conversion value (e.g., a coefficient to be multiplied with a gradation value of input image data) for converting a gradation value of the n-th comparative image into a gradation value for realizing a target characteristic. The conversion value can be calculated from a difference between the calculated ratio R_n and a ratio Rt (a ratio of a measurement value of the n-th comparative image to a measurement value of the reference image) obtained when a gradation characteristic is the target characteristic.

By performing the processing concerning all the comparative images, it is possible to determine image processing parameter for setting the gradation characteristic to the target characteristic.

Note that, in this embodiment, with a measurement value of a comparative image, a measurement value of the reference image acquired at time closest to time when the measurement value of the comparative image is acquired among measurement values of the reference image obtained before the measurement value of the comparative image is associated. That is, if the processing is returned to S101 after S107 and the reference image is measured again, a re-measurement value of the reference image is associated with a measurement value of a comparative image obtained after the re-measurement of the reference image. The ratio R_n is calculated using the measurement value of the comparative image and the measurement value of the reference image associated with the measurement value of the comparative image.

Subsequently to S109, the calibrating unit 108 sets the image processing parameters determined in S109 in the image-processing unit 102 (S110). After the processing in S110, the image-processing unit 102 applies image processing to the input image data using the image processing parameters set in S110.

As explained above, according to this embodiment, during the measurement of the n-th comparative image, if the light emission state of the light-emitting unit changes from the light emission state of the light-emitting unit during the measurement of the reference image, the reference image is measured again. Thereafter, at least the n-th and subsequent comparative images are measured in order. Consequently, measurement values of the comparative images can be obtained under conditions equivalent to conditions during the measurement of the reference image. It is possible to highly accurately execute the calibration of the image display apparatus using the measurement value of the reference image and the measurement values of the comparative images.

According to this embodiment, as in the first and second embodiments, in an execution period of the calibration, an image based on the input image data is displayed by processing same as the processing in the other periods. Consequently, it is possible to execute the calibration of the image display apparatus while suppressing deterioration in the quality of a displayed image.

Note that, in this embodiment, the example is explained in which, after the reference image is displayed on the screen again, the n-th and subsequent comparatively images (the N−n+1 comparative images) are displayed on the screen in order. However, display of comparative images is not limited to this. After the reference image is displayed on the screen again, more than N−n+1 comparative images may be displayed on the screen in order. For example, after the reference image is displayed on the screen again, N comparative images may be displayed on the screen in order.

Note that, in this embodiment, the example is explained in which, when the calibration is performed, the measurement value of the reference image and the measurement value of the comparative image are compared. However, for example, the measurement value of the reference image does not have to be used. The measurement value of the reference image does not have to be acquired. The image processing parameters may be determined by performing processing same as the processing in the first and second embodiments using measurement values of the N comparative images.

Figure 13:
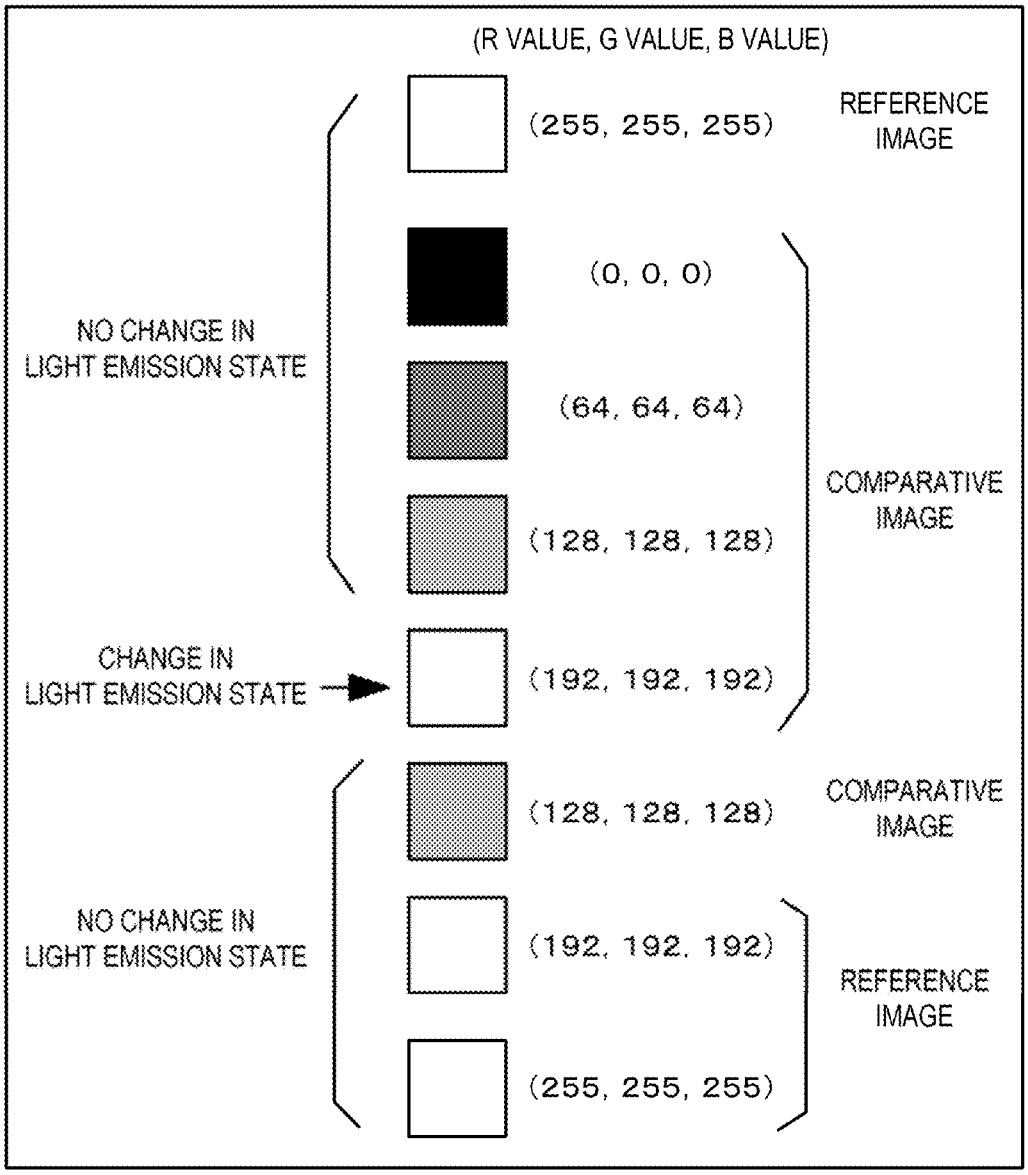
FIG. 13 is a diagram showing an example of measurement order of images for measurement according to the third embodiment.

Note that, in this embodiment, the example is explained in which the pixel values of the reference images are fixed values. However, the pixel values of the reference image are not limited to this. For example, as shown in FIG. 13, when the n-th comparative image is displayed, if the light emission state of the light-emitting unit changes from the light emission state of the light-emitting unit at the time when the reference image is displayed on the screen, an image for measurement displayed immediately before the n-th comparative image may be displayed on the screen as the reference image. In the example shown in FIG. 13, a change in the light emission state of the light-emitting unit is detected during the measurement of the comparative image with the gradation value 192. The measurement of the comparative image with the gradation value 128 is performed immediately before the measurement of the comparative image with the gradation value 192. Therefore, in the example shown in FIG. 13, after the change of the light emission state is detected, the comparative image with the gradation value 128 is displayed on the screen as the reference image. An image for measurement displayed second immediately preceding the n-th comparative image or an image for measurement displayed earlier than the image for measurement may be displayed on the screen as the reference image. For example, if three images for measurement (one reference image and two comparative images) are measured before the measurement of the n-th comparative image, anyone of the three images for measurement may be displayed on the screen as the reference image.

[Other Embodiments]

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-078645, filed on Apr. 7, 2014, which is hereby incorporated by reference herein in its entirety.

What is claimed is:

1. An image display apparatus capable of executing calibration of at least one of brightness and a color of a screen, the image display apparatus comprising:

a light-emitting device;

a display panel configured to display an image on the screen by modulating light from the light-emitting device;

one or more processors; and one or more memories storing a program which, when executed by the one or more processors, causes the image display apparatus configured to:

control light emission of the light-emitting device on the basis of input image data;

execute, for each of a plurality of groups, to each of which two or more images for calibration belong, display processing for displaying the two or more images for calibration belonging to the group on the screen in order;

execute, for each of the plurality of images for calibration, processing for acquiring a measurement value of light emitted from a region, of the screen, where the image for calibration is displayed; and execute the calibration on the basis of the measurement values of the plurality of images for calibration, wherein for each of the plurality of groups, at least a part of the display processing for the group is executed again in a case where it is determined that a light emission state of the light-emitting device changed during the execution of the display processing for the group from a light emission state of the light-emitting device before the execution of the display processing.

2. The image display apparatus according to claim 1, wherein the light-emitting device includes a plurality of light sources, the light emission of which can be individually controlled, in the control of the light emission, the light emission of each of the plurality of light sources is controlled on the basis of image data to be displayed in a region of the screen corresponding to each of the plurality of light sources, the plurality of images for calibration are displayed in a same region of the screen in the display processing, and the light emission state of the light-emitting device is a light emission state of the light-emitting device in the region where the images for calibrations are displayed.

3. The image display apparatus according to claim 1, wherein the image display apparatus caused by executing the program is configured to further determine whether a degree of change of the light emission state of the light-emitting device during the execution of the display processing with respect to the light emission state of the light-emitting device before the execution of the display processing is equal to or larger than a threshold, and in a case where it is determined that the degree of change is equal to or larger than the threshold, at least a part of the display processing is executed again.

4. The image display apparatus according to claim 3, wherein the degree of change is a rate of change ΔE calculated from a light emission state Da of the light-emitting device before the execution of the display processing and a light emission state Db of the light-emitting device during the execution of the display processing using the following expression:

$$\Delta E=|(Db-Da)/Da|.$$

5. The image display apparatus according to claim 1, wherein the light emission state of the light-emitting device includes at least one of light emission brightness and a light emission color of the light-emitting device.

6. The image display apparatus according to claim 1, wherein the light-emitting device emits light corresponding to a set light emission control value, in the control of the light emission, a light emission control value set in the light-emitting device is controlled, and the image display apparatus caused by executing the program is configured to further determine the light emission state of the light-emitting device on the basis of the light emission control value set in the light-emitting device.

7. The image display apparatus according to claim 1, wherein the image display apparatus caused by executing the program is configured to further determine the light emission state of the light-emitting device on the basis of the input image data.

8. The image display apparatus according to claim 1, further comprising a measuring sensor configured to measure light from the light-emitting device, wherein a measurement value of the measuring sensor is used as the light emission state of the light-emitting device.

9. An image display apparatus capable of executing calibration of at least one of brightness and a color of a screen, the image display apparatus comprising:

a light-emitting device;

a display panel configured to display an image on the screen by modulating light from the light-emitting device;

one or more processors; and one or more memories storing a program which, when executed by the one or more processors, causes the image display apparatus configured to:

control light emission of the light-emitting device on the basis of input image data;

execute display processing for displaying a plurality of images for calibration on the screen in order;

execute, for each of the plurality of images for calibration, processing for acquiring a measurement value of light emitted from a region, of the screen, where the image for calibration is displayed; and execute the calibration on the basis of the measurement values of the plurality of images for calibration, wherein in the execution of the display processing, display processing for displaying a first image, which is a reference image for calibration, on the screen and thereafter displaying N (N is an integer equal to or larger than 2) second images, which are N images for calibration, on the screen in order is executed; and in a case where it is determined that the light emission state of the light-emitting device at the time when an n-th (n is an integer equal to or larger than 1 and equal to or smaller than N) second image is displayed changed from the light emission state of the light-emitting device at the time when the first image is displayed on the screen, display processing for displaying the first image on the screen again and thereafter displaying at least the n-th and subsequent second images on the screen in order is executed.

10. The image display apparatus according to claim 9, wherein in the case where it is determined that the light emission state of the light-emitting device at the time when the n-th second image is displayed changed from the light emission state of the light-emitting device at the time when the first image is displayed on the screen, an image for calibration displayed immediately preceding the n-th second image is displayed on the screen as the first image.

11. The image display apparatus according to claim 9, wherein in the execution of the processing for acquiring the measurement value, a measurement value of the first image and measurement values of the N second images are acquired, and in the execution of the calibration, for each of the second images, the measurement value of the second image and the measurement value of the first image are compared, and the calibration is executed on the basis of comparison results of the second images.

12. A control method for an image display apparatus capable of executing calibration of at least one of brightness and a color of a screen, the image display apparatus including:

a light-emitting device; and a display panel configured to display an image on the screen by modulating light from the light-emitting device, the control method comprising:

controlling light emission of the light-emitting device on the basis of input image data;

executing, for each of a plurality of groups, to each of which two or more images for calibration belong, display processing for displaying the two or more images for calibration belonging to the group on the screen in order;

executing, for each of the plurality of images for calibration, processing for acquiring a measurement value of light emitted from a region, of the screen, where the image for calibration is displayed; and executing the calibration on the basis of the measurement values of the plurality of images for calibration, wherein for each of the plurality of groups, at least a part of the display processing for the group is executed again in a case where it is determined that a light emission state of the light-emitting device changed during the execution of the display processing for the group from a light emission state of the light-emitting device before the execution of the display processing.

13. A non-transitory computer readable medium that stores a program, wherein the program causes a computer to execute a method for an image display apparatus capable of executing calibration of at least one of brightness and a color of a screen, the image display apparatus includes:

a light-emitting device; and a display panel configured to display an image on the screen by modulating light from the light-emitting device, the control method includes:

controlling light emission of the light-emitting device on the basis of input image data;

executing, for each of a plurality of groups, to each of which two or more images for calibration belong, display processing for displaying the two or more images for calibration belonging to the group on the screen in order;

executing, for each of the plurality of images for calibration, processing for acquiring a measurement value of light emitted from a region, of the screen, where the image for calibration is displayed; and executing the calibration on the basis of the measurement values of the plurality of images for calibration, and in the control method, for each of the plurality of groups, at least a part of the display processing for the group is executed again in a case where it is determined that a light emission state of the light-emitting device changed during the execution of the display processing for the group from a light emission state of the light-emitting device before the execution of the display processing.

14. A control method for an image display apparatus capable of executing calibration of at least one of brightness and a color of a screen, the image display apparatus including:

a light-emitting device; and a display panel configured to display an image on the screen by modulating light from the light-emitting device;

the control method comprising:

controlling light emission of the light-emitting device on the basis of input image data;

executing display processing for displaying a plurality of images for calibration on the screen in order;

executing, for each of the plurality of images for calibration, processing for acquiring a measurement value of light emitted from a region, of the screen, where the image for calibration is displayed; and executing the calibration on the basis of the measurement values of the plurality of images for calibration, wherein in the execution of the display processing, display processing for displaying a first image, which is a reference image for calibration, on the screen and thereafter displaying N (N is an integer equal to or larger than 2) second images, which are N images for calibration, on the screen in order is executed; and in a case where it is determined that the light emission state of the light-emitting device at the time when an n-th (n is an integer equal to or larger than 1 and equal to or smaller than N) second image is displayed changed from the light emission state of the light-emitting device at the time when the first image is displayed on the screen, display processing for displaying the first image on the screen again and thereafter displaying at least the n-th and subsequent second images on the screen in order is executed.

15. A non-transitory computer readable medium that stores a program, wherein the program causes a computer to execute a method for an image display apparatus capable of executing calibration of at least one of brightness and a color of a screen, the image display apparatus includes:

a light-emitting device; and a display panel configured to display an image on the screen by modulating light from the light-emitting device, the control method includes:

controlling light emission of the light-emitting device on the basis of input image data;

executing display processing for displaying a plurality of images for calibration on the screen in order;

executing, for each of the plurality of images for calibration, processing for acquiring a measurement value of light emitted from a region, of the screen, where the image for calibration is displayed; and executing the calibration on the basis of the measurement values of the plurality of images for calibration, and in the execution of the display processing, display processing for displaying a first image, which is a reference image for calibration, on the screen and thereafter displaying N (N is an integer equal to or larger than 2) second images, which are N images for calibration, on the screen in order is executed; and in a case where it is determined that the light emission state of the light-emitting device at the time when an n-th (n is an integer equal to or larger than 1 and equal to or smaller than N) second image is displayed changed from the light emission state of the light-emitting device at the time when the first image is displayed on the screen, display processing for displaying the first image on the screen again and thereafter displaying at least the n-th and subsequent second images on the screen in order is executed.

* * * * *